US011712088B2

(12) United States Patent
Bell et al.

(10) Patent No.: US 11,712,088 B2
(45) Date of Patent: Aug. 1, 2023

(54) KNITTED MEMBER FOR AN ARTICLE OF FOOTWEAR

(71) Applicant: NIKE, Inc., Beaverton, OR (US)

(72) Inventors: Thomas G. Bell, Portland, OR (US); Scott C. Holt, Portland, OR (US); Thomas J. Rushbrook, Portland, OR (US); Sam Amis, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 80 days.

(21) Appl. No.: 17/240,855

(22) Filed: Apr. 26, 2021

(65) Prior Publication Data

US 2021/0244130 A1 Aug. 12, 2021

Related U.S. Application Data

(63) Continuation of application No. 15/180,333, filed on Jun. 13, 2016, now Pat. No. 11,000,095.

(60) Provisional application No. 62/180,984, filed on Jun. 17, 2015.

(51) Int. Cl.

| | |
|---|---|
| ***A43B 23/02*** | (2006.01) |
| ***D04B 21/10*** | (2006.01) |
| ***A43B 1/04*** | (2022.01) |
| ***A43B 3/04*** | (2006.01) |
| ***A43B 3/08*** | (2006.01) |
| ***A43B 23/04*** | (2006.01) |
| ***A43C 1/04*** | (2006.01) |

(52) U.S. Cl.

CPC ..... *A43B 23/028* (2013.01); *A43B 1/04* (2013.01); *A43B 3/04* (2013.01); *A43B 3/08* (2013.01); *A43B 23/027* (2013.01); *A43B 23/0245* (2013.01); *A43B 23/0275* (2013.01); *A43B 23/042* (2013.01); *A43C 1/04* (2013.01); *D04B 21/10* (2013.01); *D10B 2403/023* (2013.01); *D10B 2501/043* (2013.01)

(58) Field of Classification Search

CPC .... A43B 1/04; A43B 3/04; A43B 3/08; A43B 23/0235; A43B 23/0245; A43B 23/0265; A43B 23/027; A43B 23/0275; A43B 23/042; A43B 23/028; A43C 1/04; D04B 21/10; D10B 2501/043; D10B 2403/023

USPC ..... 36/45; 66/178 R, 180, 185

See application file for complete search history.

(56) References Cited

U.S. PATENT DOCUMENTS

| | | | | |
|---|---|---|---|---|
| 2,069,381 A * | 2/1937 | Morgan | ..... | A43B 23/024 D2/974 |
| 2,400,692 A | 5/1946 | Herbert | | |
| 2,691,286 A | 10/1954 | Cooper | | |

(Continued)

FOREIGN PATENT DOCUMENTS

| | | |
|---|---|---|
| BE | 531 033 A | 11/1957 |
| CA | 427614 A | 5/1945 |

(Continued)

OTHER PUBLICATIONS

Extended European Search Report, dated Mar. 18, 2020, for European Patent Application No. 19217337.5, 8 pages.

(Continued)

*Primary Examiner* — Jocelyn Bravo

(74) *Attorney, Agent, or Firm* — Klarquist Sparkman, LLP

(57) ABSTRACT

A warp knit element for an article of footwear includes a plurality of cell structures that extend from a sole structure to a lacing region of an upper.

18 Claims, 17 Drawing Sheets

(56) References Cited

U.S. PATENT DOCUMENTS

| | | | | |
|---|---|---|---|---|
| 2,992,550 | A | 7/1961 | Frith | |
| 3,447,345 | A | 6/1969 | Kurz | |
| 4,074,543 | A | 2/1978 | Schmidt | |
| 4,265,032 | A | 5/1981 | Levine | |
| 4,858,339 | A * | 8/1989 | Hayafuchi | A43B 23/0225 36/114 |
| 5,601,907 | A * | 2/1997 | Matsumoto | D04B 21/10 428/134 |
| 6,170,175 | B1 | 1/2001 | Funk | |
| 6,250,117 | B1 * | 6/2001 | Wunner | D04B 27/34 66/195 |
| 6,314,768 | B2 * | 11/2001 | Motoya | D04B 21/10 66/195 |
| 6,401,364 | B1 * | 6/2002 | Burt | A43B 7/082 36/3 R |
| 6,757,991 | B2 | 7/2004 | Sussmann | |
| 7,155,846 | B2 | 1/2007 | Alfaro et al. | |
| 7,269,978 | B2 | 9/2007 | Amigo | |
| 8,065,818 | B2 | 11/2011 | Greene et al. | |
| 8,800,172 | B2 | 8/2014 | Dua et al. | |
| 9,420,844 | B2 | 8/2016 | Meir et al. | |
| 9,681,704 | B2 * | 6/2017 | Podhajny | A43B 23/025 |
| 9,681,708 | B2 | 6/2017 | Greene et al. | |
| 2003/0106346 | A1 * | 6/2003 | Matsumoto | D04B 21/10 66/195 |
| 2005/0076536 | A1 | 4/2005 | Hatfield et al. | |
| 2005/0081402 | A1 * | 4/2005 | Orei | A43B 1/04 36/45 |
| 2005/0193592 | A1 | 9/2005 | Bhupesh et al. | |
| 2007/0180730 | A1 * | 8/2007 | Greene | B29D 35/146 36/3 R |
| 2009/0107012 | A1 | 4/2009 | Cheney et al. | |
| 2010/0154256 | A1 * | 6/2010 | Dua | D04B 1/16 12/146 B |
| 2011/0113648 | A1 | 5/2011 | Leick et al. | |
| 2011/0302810 | A1 | 12/2011 | Borel et al. | |
| 2012/0030965 | A1 | 2/2012 | Greene et al. | |
| 2012/0198894 | A1 * | 8/2012 | Lecuivre | D04B 21/10 66/202 |
| 2012/0210600 | A1 * | 8/2012 | Joubert | A43C 15/10 36/7.1 R |
| 2012/0255201 | A1 | 10/2012 | Little | |
| 2013/0019500 | A1 * | 1/2013 | Greene | A43B 23/0245 36/50.1 |
| 2013/0260104 | A1 | 10/2013 | Dua et al. | |
| 2013/0312284 | A1 * | 11/2013 | Berend | A43B 23/0235 36/83 |
| 2014/0059896 | A1 | 3/2014 | Weidl et al. | |
| 2014/0109286 | A1 | 4/2014 | Blakely et al. | |
| 2014/0115923 | A1 | 5/2014 | Thaler et al. | |
| 2014/0173932 | A1 | 6/2014 | Bell | |
| 2014/0259760 | A1 * | 9/2014 | Dojan | A43B 23/0225 12/146 C |
| 2014/0352173 | A1 | 12/2014 | Bell et al. | |
| 2015/0040431 | A1 | 2/2015 | Woodman et al. | |
| 2015/0089841 | A1 | 4/2015 | Smaldone et al. | |
| 2015/0216258 | A1 * | 8/2015 | Ueda | A43B 23/0235 36/87 |
| 2016/0174660 | A1 | 6/2016 | Iuchi et al. | |
| 2016/0366978 | A1 * | 12/2016 | Holt | A43B 3/26 |
| 2016/0366979 | A1 | 12/2016 | Bell et al. | |
| 2016/0366980 | A1 | 12/2016 | Bell et al. | |
| 2017/0020231 | A1 | 1/2017 | Hausmann et al. | |
| 2017/0119101 | A1 * | 5/2017 | Takada | A43B 23/0275 |
| 2017/0208900 | A1 | 7/2017 | Boucher et al. | |

FOREIGN PATENT DOCUMENTS

| | | | |
|---|---|---|---|
| CN | 101267752 | A | 9/2008 |
| CN | 101756428 | A | 6/2010 |
| CN | 103841851 | A | 6/2014 |
| CN | 104486959 | A | 4/2015 |
| EP | 2 792 264 | A2 | 10/2014 |
| GB | 1 016 554 | A | 1/1966 |
| JP | 06038608 | U | 5/1994 |
| WO | WO 2016/118337 | | 7/2016 |

OTHER PUBLICATIONS

International Search Report and Written Opinion, dated Oct. 20, 2016, from related PCT Patent Application No. PCT/US2016/037589, 18 pages.

* cited by examiner

KNITTED MEMBER FOR AN ARTICLE OF FOOTWEAR

CROSS REFERENCE TO RELATED APPLICATIONS

This application is a continuation of U.S. patent application Ser. No. 15/180,333, filed Jun. 13, 2016, which claims the benefit of U.S. Provisional Application No. 62/180,984, filed Jun. 17, 2015. The prior applications are incorporated herein by reference in their entirety.

BACKGROUND

Conventional articles of footwear generally include two primary elements: an upper and a sole structure. The upper is secured to the sole structure and forms a void within the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal a lower surface of the foot to enhance footwear comfort.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally utilized in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. With regard to an exterior of the upper, the toe area and the heel area may be formed of leather, synthetic leather, or a rubber material to impart a relatively high degree of wear-resistance. Leather, synthetic leather, and rubber materials may not exhibit the desired degree of flexibility and air-permeability for various other areas of the exterior. Accordingly, the other areas of the exterior may be formed from a synthetic textile, for example. The exterior of the upper may be formed, therefore, from numerous material elements that each imparts different properties to the upper. An intermediate or central layer of the upper may be formed from a lightweight polymer foam material that provides cushioning and enhances comfort. Similarly, an interior of the upper may be formed of a comfortable and moisture-wicking textile that removes perspiration from the area immediately surrounding the foot. The various material elements and other components may be joined with an adhesive or stitching. Accordingly, the conventional upper is formed from various material elements that each imparts different properties to various areas of the footwear.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

The embodiments described, depicted, claimed, or otherwise disclosed herein resolve one or more of the shortcomings of the prior art discussed above.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

Figure 9:
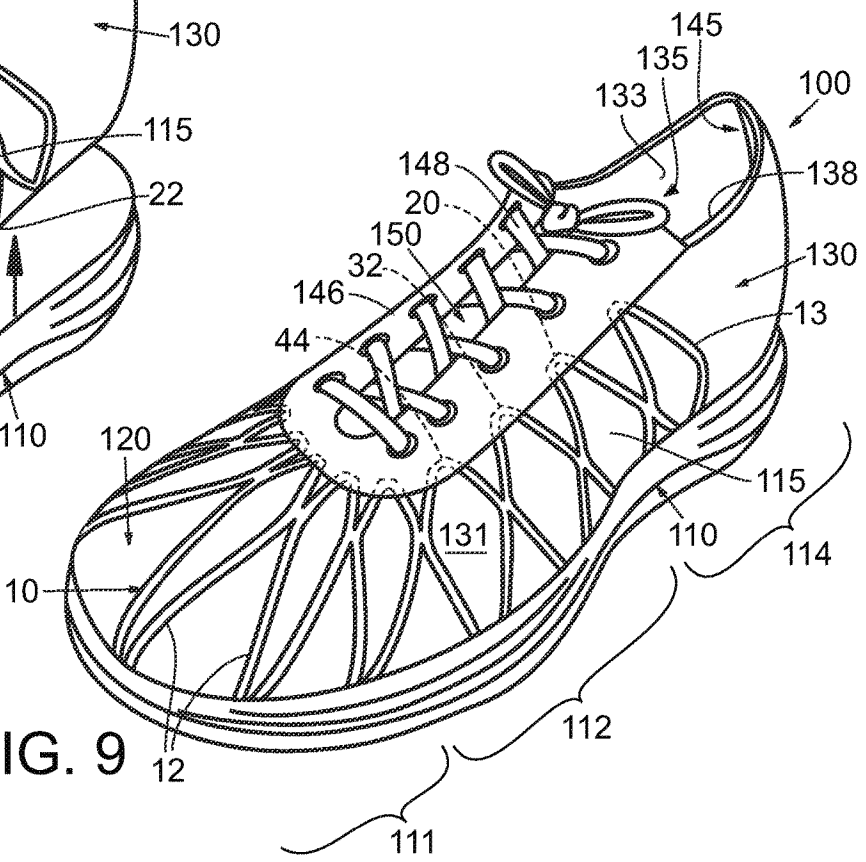
FIG. 9 is an assembled perspective view of the article of footwear of FIG. 8.
Figure 10:
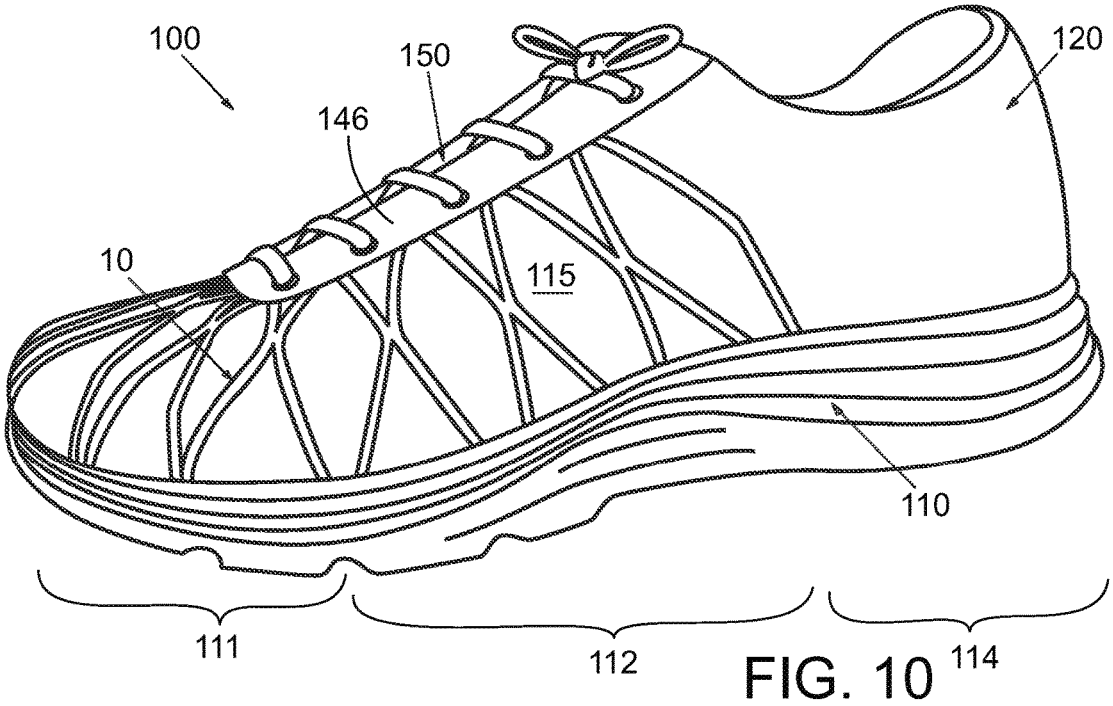
FIG. 10 is a lateral side view of the article of footwear of FIG. 9.
Figure 11:
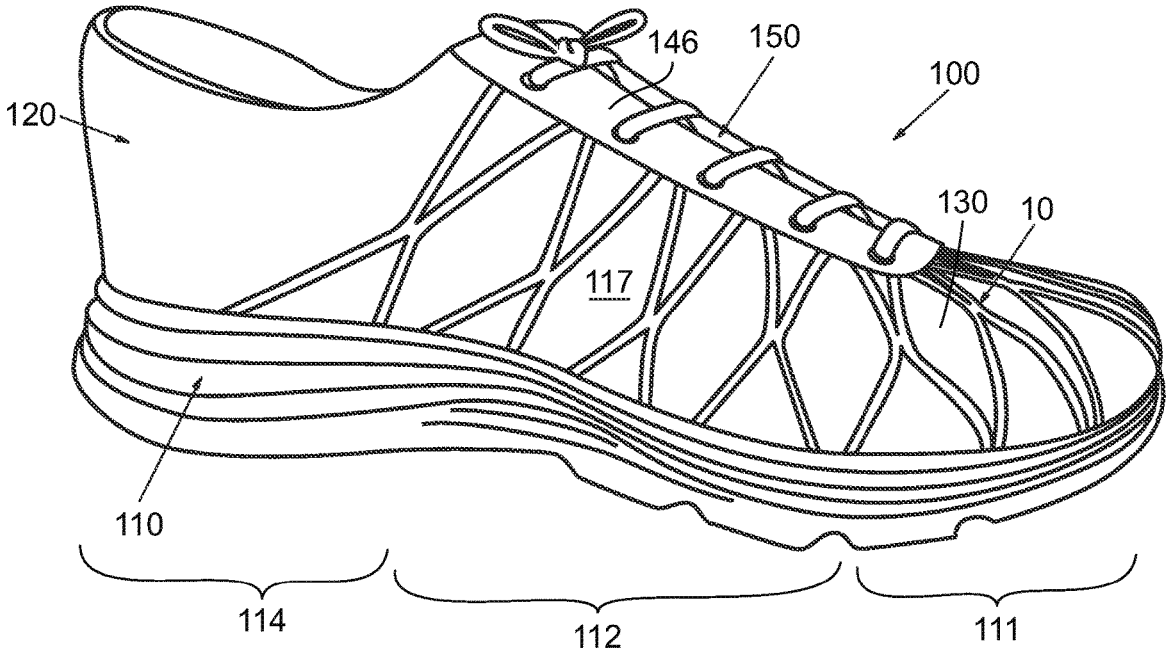
FIG. 11 is a medial side view of the article of footwear of FIG. 9.

Referring initially to FIGS. 1-11, a knit element 10 is illustrated according to exemplary embodiments. The knit element 10 can be incorporated in an article of footwear 100 as shown in the embodiments of FIGS. 9-11. Methods of forming the knit element 10 and the article of footwear 100 are also indicated according to exemplary embodiments.

As will be discussed, knit element 10 can form at least part of the article of footwear 100. For example, knit element 10 can be incorporated in an upper 120 of footwear 100. Knit element 10 can provide support to the upper 120 and/or to the wearer's foot. For example, in some embodiments, knit element 10 can provide stretch resistance to upper 120. Also, in some embodiments, knit element 10 can provide reinforcement to the upper 120. Knit element 10 can also extend about the wearer's foot and, in some embodiments, maintain the foot substantially over a sole structure 110 of the article of footwear 100.

Also, as will be discussed, the knit element 10 can be formed via a knitting process. For example, in some embodiments, the knit element 10 can be formed via a warp knitting process, as shown in the exemplary embodiments of FIGS. 12 and 13. In other embodiments, the knit element 10 can be formed via a weft knitting process or other process. Also, certain features of the knit element 10 can be formed via the knitting process. These features can be formed in predetermined areas of the knit element 10, and as such, the features can be incorporated in predetermined areas of the article of footwear 100.

Figure 2:
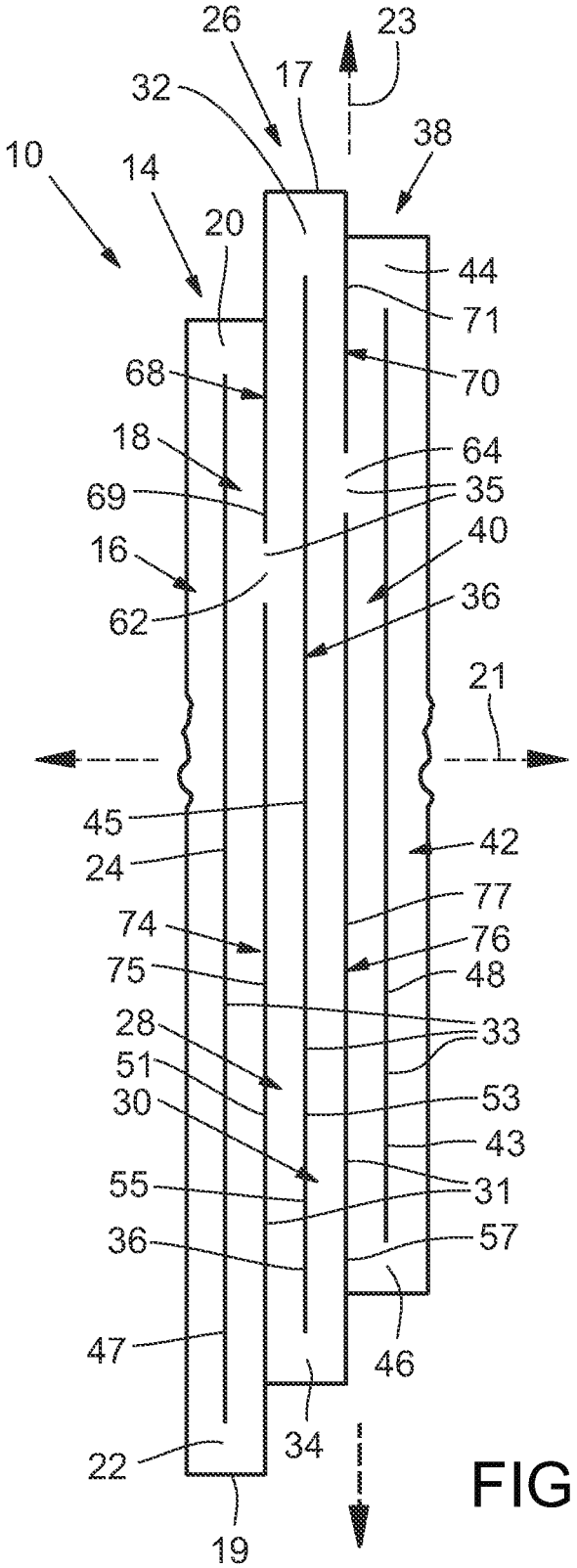
FIG. 2 is a plan view of a portion the knit element of FIG. 1 shown in a contracted position.
Figure 3:
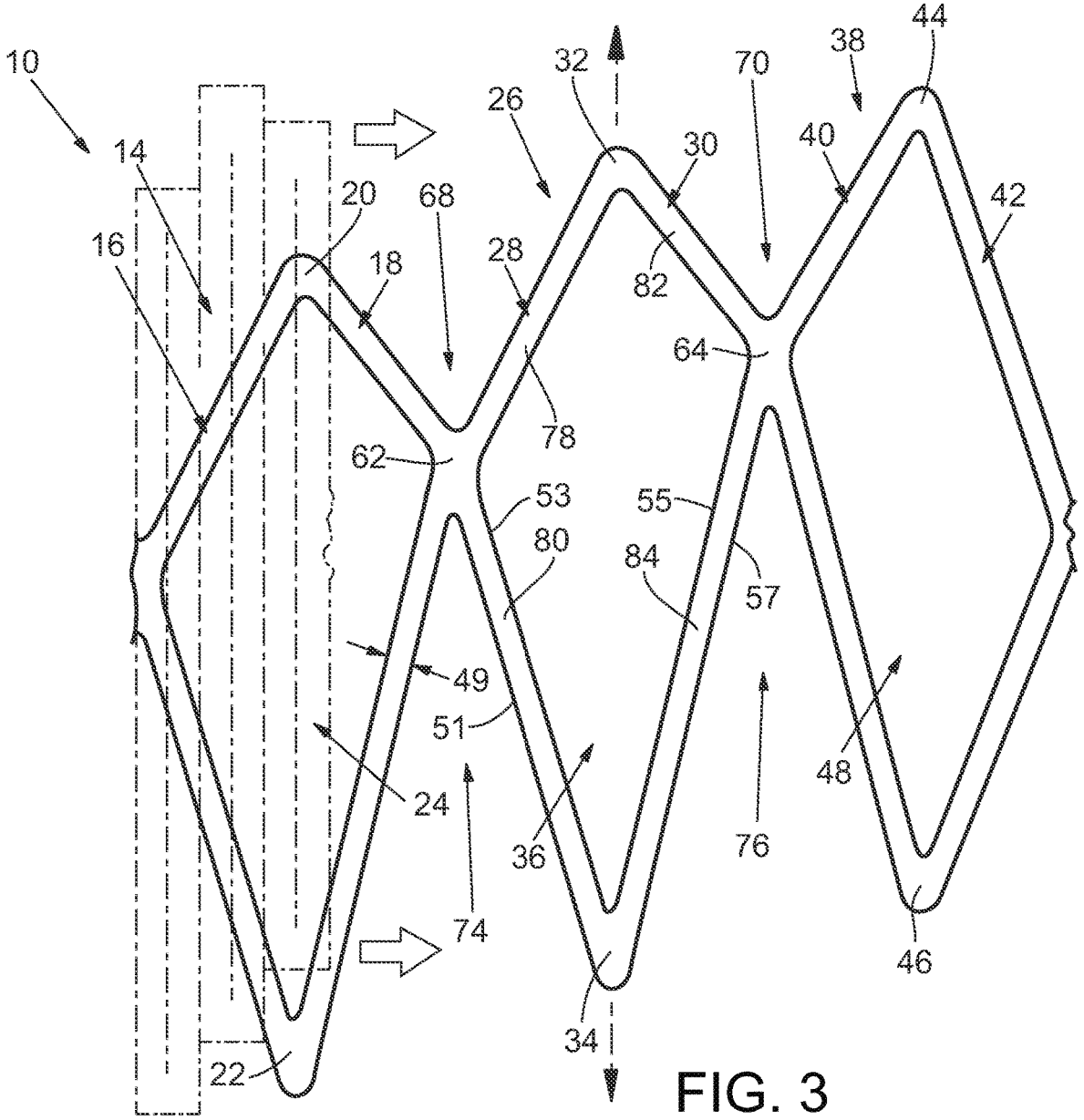
FIG. 3 is a plan view of the portion of the knit element of FIG. 2 shown in an expanded position, wherein the contracted position is shown in phantom.
Figure 4:
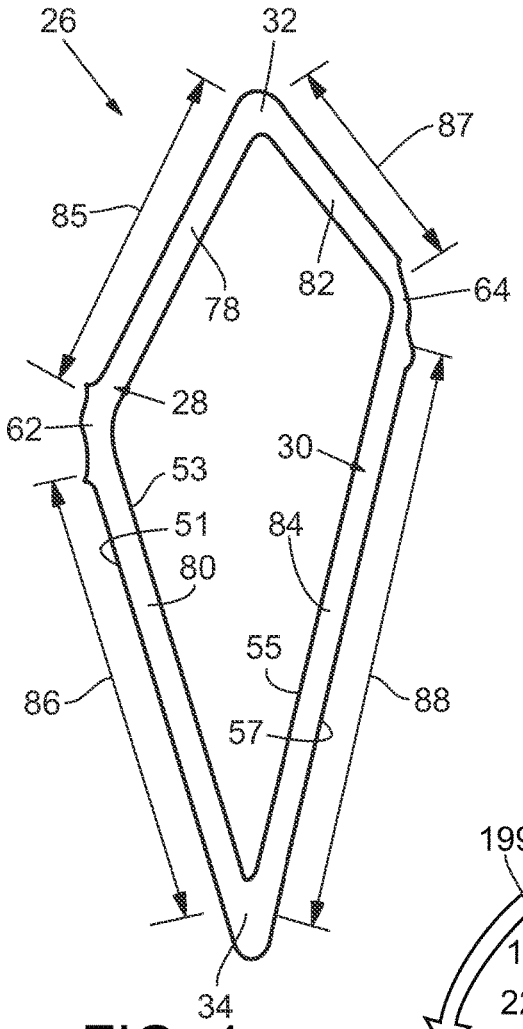
FIG. 4 is a plan view of an expansion component of the knit element of FIG. 1.

For example, knit element 10 can be knitted to include one or more relatively narrow openings 31, 33, such as slits. These narrow openings 31, 33 can divide the knit element 10 into a plurality of knit portions. More specifically, in some embodiments, the openings 31, 33 can divide the knit element 10 into a plurality of knitted strap members 51 as will be discussed in detail below. The strap members 51 can, thus, move relative to each other and enable the knit element 10 to move between a first, contracted position (FIGS. 1 and 2) and a second, expanded position (FIGS. 3 and 4). Accordingly, the knit element 10 can be highly flexible and expandable as the knitted strap members 51 move relative to each other.

Also, the knitted construction of element 10 can provide certain features to the article of footwear 100. For example, the knit element 10 can be flexible and expandable in one direction and can exhibit a high degree of stretch resistance in another direction. Thus, in some embodiments, knit element 10 can be oriented on the article of footwear 100 such that the knit element 10 resists stretching along a known load path.

Exemplary embodiments of the knit element 10 will now be discussed in greater detail. In some embodiments, knit element 10 can include features and can be formed according to Nonprovisional Patent Application No. 62/181,015, filed on Jun. 17, 2015, and the disclosure of which application is incorporated by reference in its entirety.

Figure 1:
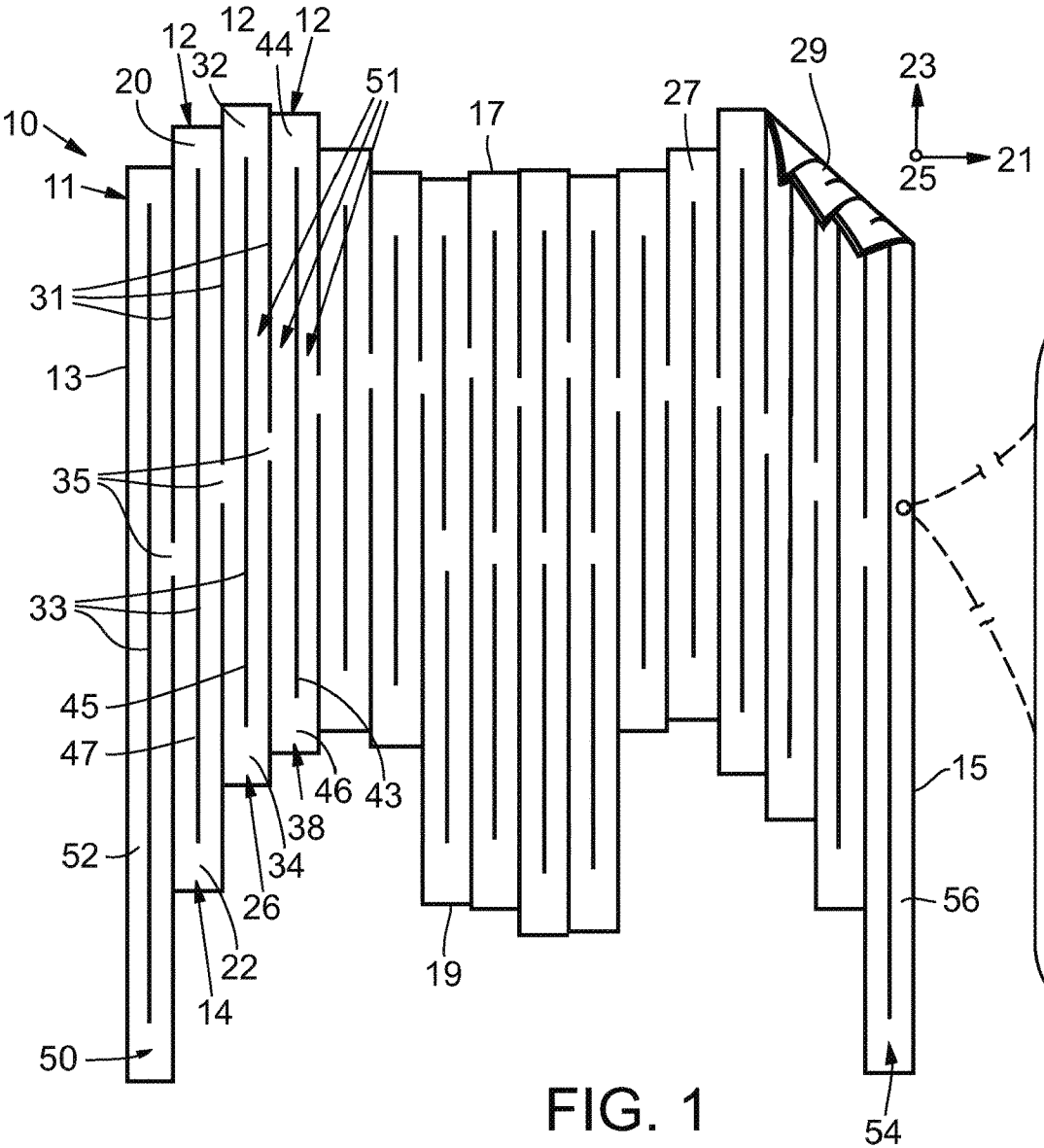
FIG. 1 is a plan view of a knit element for an article of footwear according to exemplary embodiments of the present disclosure.

As shown in FIG. 1, in some embodiments, knit element 10 can include a first surface 27 and an opposite second surface 29. Also, knit element 10 can include an outer periphery 11.

In the embodiment of FIG. 1, outer periphery 11 can be generally subdivided into a first peripheral edge 13, a second peripheral edge 15, a third peripheral edge 17, and a fourth peripheral edge 19. First peripheral edge 13 and second peripheral edge 15 can be opposite each other. In addition, in some embodiments, third peripheral edge 17 and fourth peripheral edge 19 can be opposite each other and each can extend generally between first peripheral edge 13 and second peripheral edge 15. As will be discussed, in some embodiments, third peripheral edge 17 and/or further peripheral edge 19 can be uneven (e.g., staggered, stepped, wavy, etc.).

Knit element 10 can extend and span in a width direction along a first axis 21. Also, knit element 10 can extend and span in a length direction (i.e., a transverse direction) along a second axis 23. Moreover, knit element 10 can have a thickness measured along a third axis 25. First, second, and third axis 25 can be orthogonal to each other. It will be appreciated that first, second, and third axes 21, 23, 25 are merely mentioned for purposes of discussion of features of knit element 10.

Knit element 10 can generally include a plurality of expansion components 12. The expansion components 12 can allow knit element 10 to move between the first, contracted position of FIGS. 1 and 2 and the second, expanded position of FIGS. 3 and 4. In the exemplary embodiment of FIG. 3, the expanded position is shown in solid lines and the contracted position is shown in phantom for purposes of comparison.

Knit element 10 can also include a plurality of intermediate junctions 35 that join adjacent pairs of the expansion components 12. Moreover, knit element 10 can include a plurality of external openings 31 that each extend from one of the intermediate junctions 35 to the outer periphery 11 of the knit element 10. External openings 31 can partially separate apart adjacent pairs of the expansion components 12. Furthermore, knit element 10 can include a plurality of internal openings 33 that are included on and extend through respective ones of the expansion components 12.

Knit element 10 can exhibit a high degree of flexibility and expandability. As shown in FIG. 3, knit element 10 can expand linearly along the first axis 21 in some embodiments. Stated differently, an expansion direction of knit element 10 can be substantially parallel to the first axis 21 in some embodiments. Also, in some embodiments represented in FIG. 6, knit element 10 can be expanded along a non-linear path (e.g., expanded about the third axis 25). Stated differently, the expansion direction of knit element 10 can curve about the third axis 25 in some embodiments. Thus, as will be discussed, knit element 10 can extend about a complexly curved surface of the upper 120 and/or the wearer's foot.

Expansion components 12 can have a predetermined shape and arrangement within knit element 10. These features can allow knit element 10 to expand along a predetermined path. Also, these features of expansion components 12 can allow knit element 10 to fit to the upper 120 and/or the wearer's foot in a desirable manner. For example, in some embodiments, the shape and arrangement of expansion components 12 can allow knit element 10 to lie smoothly against other portions of the upper 120 of the article of footwear 100.

Knit element 10 can include any number of expansion components 12. For example, as shown in the embodiment of FIG. 1, knit element 10 can include sixteen expansion components 12. However, it will be appreciated that number of expansion components 12 can vary from the illustrated embodiment without departing from the scope of the present disclosure.

The plurality of expansion components 12 can include a first expansion component 14, a second expansion component 26, and a third expansion component 38, each of which will be discussed in detail below. FIG. 2 illustrates these expansion components 14, 26, 38 in the contracted position, and FIG. 3 illustrates these expansion components 14, 26, 38 in the expanded position. FIG. 4 illustrates expansion component 26 independently in the expanded position. It will be appreciated that first, second, and/or third expansion components 14, 26, 38 can be representative of one or more other expansion components 12 of the knit element 10.

As mentioned, knit element 10 can include a plurality of internal openings 33. For example, in some embodiments, first expansion component 14 can include a first internal opening 24, which divides first expansion component 14 into a first strap member 16 and a second strap member 18. First strap member 16 and second strap member 18 can be joined at a first end junction 20 and an opposite second end junction 22. First internal opening 24 can extend between first end junction 20 and second end junction 22. In some embodiments, first internal opening 24 can be configured as a first internal slit 47 when knit element 10 is in the contracted position of FIGS. 1 and 2. As such, the edges of knit element 10 defining the first internal slit 47 can be immediately adjacent each other. For example, the edges of knit element 10 defining the first internal slit 47 can abut when knit element 10 is in the contracted position. Accordingly, the first and second strap members 16, 18 can be separated along a portion of their length by the slit 47, and the first and second strap members 16, 18 can be at least partially joined at the first end junction 20 and the second end junction 22.

Additionally, as shown in FIG. 3, first strap member 16 and second strap member 18 can be elongate and relatively thin in some embodiments. For example, first strap member 16 and/or second strap member 18 can have a width 49 that is less than 0.5 inches. Also, in some embodiments, the width 49 can be less than 0.2 inches.

In some embodiments, second expansion component 26 can be substantially similar to first expansion component 14. Specifically, second expansion component 26 can include a second internal opening 36, which divides second expansion component 26 into a first strap member 28 and a second strap member 30. First strap member 28 and second strap member 30 can be joined at a first end junction 32 and an opposite second end junction 34. In some embodiments, second internal opening 36 can be configured as a second internal slit 45 when knit element 10 is in the contracted position of FIGS. 1 and 2. As such, the edges of knit element 10 defining the second internal slit 45 can be immediately adjacent each other. For example, the edges of knit element 10 defining the second internal slit 45 can abut when knit element 10 is in the contracted position.

Moreover, in some embodiments, third expansion component 38 can be substantially similar to first expansion component 14 and second expansion component 26. Specifically, third expansion component 38 can include a third internal opening 48, which divides third expansion component 38 into a first strap member 40 and a second strap member 42. First strap member 40 and second strap member 42 can be joined at a first end junction 44 and an opposite second end junction 46. In some embodiments, third internal opening 48 can be configured as a third internal slit 43 when knit element 10 is in the contracted position of FIGS. 1 and 2. As such, the edges of knit element 10 defining the third internal slit 43 can be immediately adjacent each other. For example, the edges of knit element 10 defining the third internal slit 43 can abut when knit element 10 is in the contracted position.

First, second, and third expansion components 14, 26, 38 can be arranged in a row that extends generally along the first axis 21. First, second, and third expansion components 14, 26, 38 can be attached via the plurality of intermediate junctions 35. In some embodiments, second expansion component 26 can be disposed between first expansion component 14 and third expansion component 38 within the row. Also, in some embodiments, a first intermediate junction 62 can join first strap member 28 of second expansion component 26 to second strap member 18 of first expansion component 14. Likewise, in some embodiments, a second intermediate junction 64 can join second strap member 30 of second expansion component 26 to first strap member 40 of third expansion component 38.

Additionally, as mentioned above, knit element 10 can include the plurality of external openings 31 that separate adjacent pairs of the expansion components 12. For example, as shown in FIGS. 2 and 3, the plurality of external openings 31 can include a first external opening 68, a second external opening 70, a third external opening 74, and a fourth external opening 76. In some embodiments represented in FIG. 2, first external opening 68 can extend from first intermediate junction 62 to third peripheral edge 17. Also, second external opening 70 can extend from second intermediate junction 64 to third peripheral edge 17. First and second external openings 68, 70 can be open at third peripheral edge 17 in some embodiments. Moreover, third external opening 74 can extend from first intermediate junction 62 to fourth peripheral edge 19, and fourth external opening 76 can extend from second intermediate junction 64 to fourth peripheral edge 19. In some embodiments, third and fourth external openings 74, 76 can be open at fourth peripheral edge 19.

In some embodiments represented in FIG. 2, first external opening 68 can be configured as a first external slit 69 when knit element 10 is in the contracted position. As such, the edges of knit element 10 defining the first external slit 69 can be immediately adjacent each other. For example, the edges of knit element 10 defining the first external slit 69 can abut when knit element 10 is in the contracted position. Similarly, second external opening 70 can be configured as a second external slit 71, third external opening 74 can be configured as a third external slit 75, and fourth external opening 76 can be configured as a fourth external slit 77 in some embodiments.

As shown in FIGS. 3 and 4, first strap member 28 of second expansion component 26 can be sub-divided into a first upper segment 78 and a first lower segment 80. First upper segment 78 and first lower segment 80 can be joined at first intermediate junction 62. First upper segment 78 can extend from first end junction 32 to first intermediate junction 62. First lower segment 80 can extend from first intermediate junction 62 to second end junction 34. Also, second strap member 30 can be sub-divided into a second upper segment 82 and a second lower segment 84. Second upper segment 82 and second lower segment 84 can be joined at second intermediate junction 64. Second upper segment 82 can extend from first end junction 32 to second intermediate junction 64. Second lower segment 84 can extend from second intermediate junction 64 to second end junction 34. Also, first upper segment 78 and second upper segment 82 can be joined at a first end junction 32. First lower segment 80 and second lower segment 84 can be joined at second end junction 34. It will be appreciated that first and second strap members 16, 18 of first expansion component 14 can be similarly configured. Moreover, it will be appreciated that first and second strap members 40, 42 of third expansion component 38 can be similarly configured.

As shown in FIG. 4, first upper segment 78 can have a first length 85. First length 85 can be measured from first end junction 32 to first intermediate junction 62. Similarly, first lower segment 80 can have a second length 86, second upper segment 82 can have a third length 87, and second lower segment 84 can have a fourth length 88. In some embodiments, the combined length of the first and second lengths 85, 86 can be substantially equal to the combined length of the third and fourth lengths 87, 88 (i.e., first length+second length=third length+fourth length). It will be appreciated that first expansion component 14 and/or third expansion component 38 can have similar proportions.

Referring back to FIG. 1, the arrangement and other features of expansion components 12 within knit element 10 will be explained in greater detail according to exemplary embodiments. As stated, expansion components 12 can be arranged in a row that extends generally along the first axis 21. More specifically, the row can begin at first peripheral edge 13 and end at second peripheral edge 15. First peripheral edge 13 can be formed by a first strap member 52 of a first end expansion component 50. Second peripheral edge 15 can be formed by a second strap member 56 of a second end expansion component 54.

Also, one or more of the plurality of expansion components 12 can be offset relative to each other along the second axis 23. This can cause third peripheral edge 17 and/or fourth peripheral edge 19 to be uneven (e.g., staggered, stepped, wavy, etc.)

Additionally, in some embodiments, the end junctions of knit element 10 can be offset along the second axis 23. For example, first end junctions 20, 32, 44 can be offset relative to each other along the second axis 23. Thus, in embodiments in which first end junctions 20, 32, 44 cooperate to form third peripheral edge 17, third peripheral edge 17 can be stepped as shown in FIG. 1. Likewise, second end junctions 22, 34, 46 can be offset relative to each other along the second axis 23. Thus, in embodiments in which second end junctions 22, 34, 46 cooperate to form fourth peripheral edge 19, fourth peripheral edge 19 can be stepped as shown in FIG. 1.

Moreover, the plurality of intermediate junctions 35 can be offset relative to each other along the second axis 23. Additionally, the individual lengths of expansion components 12 within knit element 10 can differ. For example, the first expansion component 22 can have a first length measured from first end junction 20 to second end junction 22 along second axis 23, and the second expansion component 26 can have a second length measured from first end junction 32 to second end junction 34. As shown in FIG. 1, the first length of first expansion component 22 can be greater than the second length of second expansion component 26. Furthermore, the lengths of other expansion components 12 can differ.

It will be appreciated that knit element 10 can include a different configuration of support members 12 without departing from the scope of the present disclosure. For example, support members 12 can be shaped differently from those illustrated. Also, expansion components 12 can be arranged in a row as shown in FIGS. 1-3. In additional embodiments, knit element 10 can include a plurality of rows of expansion components 12. The rows can be attached, and the rows can each extend along the first axis 21 in some embodiments. Also, in some embodiments, at least some of the expansion components 12 within different rows can be arranged in different columns.

As mentioned above and as illustrated in FIG. 2, when knit element 10 is in the contracted position, at least some of the internal openings 33 can be arranged as slits, such as first internal slit 47, second internal slit 45, and third internal slit 43. Likewise, at least some of the external openings 31 can be arranged as slits, such as first external slit 69, second external slit 71, third external slit 75, and fourth external slit 77. In some embodiments, these slits can be straight, linear and substantially parallel to the second axis 23. Also, in some embodiments, two or more slits can be substantially aligned. For example, first external slit 69 and third external slit 75 can be substantially aligned. Likewise, second external slit 71 and fourth external slit 77 can be substantially aligned as well. Other pairs of slits can be similarly aligned as shown in FIG. 1. Additionally, two or more slits can have different lengths from each other. For example, as shown in the embodiment of FIG. 2, second internal slit 45 can be longer than third internal slit 43 in some embodiments.

Additionally, when in the contracted position, expansion components 12 can be rectangular and elongate. Thus, for example, first upper segment 78 and first lower segment 80 of second expansion component 26 can be substantially straight and aligned when in the contracted position. Likewise, second upper segment 82 and second lower segment 84 can be substantially straight and aligned when in the contracted position. The first expansion component 14, third expansion components 38, and/or other expansion components 12 can be similarly configured.

Referring now to FIGS. 2 and 3, expansion of the knit element 10 will now be discussed in more detail according to exemplary embodiments. To move knit element 10 away from the contracted position to second position, first peripheral edge 13 and second peripheral edge 15 can be moved away from each other. During this movement, at least some of the external openings 31 can open up (i.e., the area of the opening 31 can increase) to move the expansion components 12 away from each other. Also, as knit element 10 expands, one or more internal openings 33 can open up (i.e., the area of the opening 33 can increase). Accordingly, one or more expansion components 12 can form a substantially quadrilateral shape in the expanded position. Specifically, first upper segment 78, first lower segment 80, second upper segment 82, and second lower segment 84 can cooperate to form a substantially quadrilateral shape (e.g., a diamond-like shape) in the expanded position. The other expansion components 12 can be similarly configured when in the expanded position as shown in FIG. 3. As shown in FIG. 3, the expansion components 12 can be offset along the second axis 23 once knit element 10 is in expanded position.

To move knit element 10 from the expanded position to the contracted position, the first peripheral edge 13 and second peripheral edge 15 can be moved toward each other, generally along first axis 21. As knit element 10 moves, the external openings 31 and the internal openings 33 can close (i.e., the area of the openings 31 can reduce), and each can regain its slit-like configuration. Thus, the expansion components 12 can regain their elongate, rectangular configuration in some embodiments.

Figure 6:
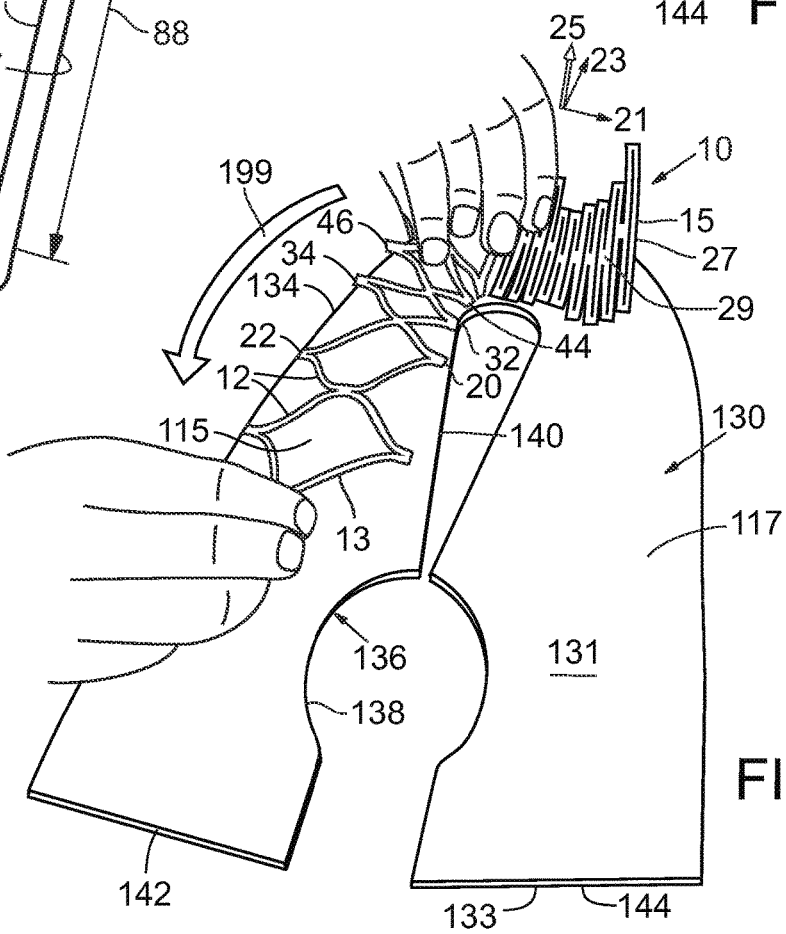
FIG. 6 is a perspective view of the knit element of FIG. 5 shown in the process of being expanded relative to the substrate.

In some embodiments, the arrangement and shape of expansion components 12, external openings 31, internal openings 33, and intermediate junctions 35 can provide knit element 10 with a high degree of expandability. For example, as noted above, knit element 10 can increase in length along the first axis 21. Also, in some embodiments represented in FIG. 6, knit element 10 can expand along a curved path. Specifically, in the embodiment illustrated, knit element 10 can expand and curve about the third axis 25 when the knit element 10 moves from the contracted position toward the expanded position. This expansion along this non-linear expansion direction is indicated in FIG. 6 with curved arrow 199.

These characteristics will be discussed in greater detail with reference to FIGS. 5-11 in which a method of assembling an upper 120 and an article of footwear 100 is illustrated according to exemplary embodiments. As shown in FIGS. 8 and 9, the upper 120 can be formed to include the knit element 10, a substrate 130, a lacing element 146, and a shoelace 148. However, it will be appreciated that upper 120 can include different elements and/or upper 120 can be configured differently without departing from the scope of the present disclosure.

Substrate 130 will be discussed according to exemplary embodiments. Substrate 130 is shown flattened, in a plan view in FIGS. 5-7, and substrate 130 is shown assembled to have more three-dimensional shape in FIGS. 8-11.

In some embodiments, substrate 130 can include a front surface 131 and an opposite back surface 133. Also, substrate 130 can include a periphery 132, which can include a generally U-shaped outer peripheral edge 134. The periphery 132 can also include an inner peripheral edge 136, which is spaced apart from and opposite the outer peripheral edge 134. Moreover, the periphery 132 can include a first heel edge 142, which can extend from the outer peripheral edge 134 to the inner peripheral edge 136 proximate a lateral side 115 of the substrate 130. Additionally, the periphery 132 can include a second heel edge 144, which can extend from the outer peripheral edge 134 to the inner peripheral edge 136 proximate a medial side 117 of the substrate 130. As shown in the illustrated embodiments, areas of substrate 130 between outer peripheral edge 134 and throat opening 140 can at least partially form a forefoot area 111, a lateral side 115, and a medial side 117 of the upper 120. Lateral side 115 and medial side 117 of substrate 130 can form portions of a midfoot region 112 of the upper 120. Furthermore, portions of substrate 130 that are proximate first heel edge 142 and second heel edge 144 can form a heel region 114 of upper 120.

Additionally, in some embodiments, substrate 130 can be a textile element or other flexible and/or stretchable element. For example, in some embodiments, substrate 130 can be a single piece of knit textile, which is formed of unitary knit construction. Also, substrate 130 can include features and teachings disclosed in U.S. Pat. No. 8,196,317, issued Jun. 12, 2012 to Dua et al., and/or U.S. Pat. No. 8,490,299, issued Jul. 23, 2013 to Dua et al., the entire disclosures of each being incorporated herein by reference.

In some embodiments, the substrate 130 can be a relatively lightweight, stretchable or otherwise flexible member. In some embodiments, knit element 10 can be attached to substrate 130 to provide stretch resistance to the substrate 130. Knit element 10 can be included for other reasons as well. For example, knit element 10 can be included for reinforcing substrate 130 to make the upper 120 more durable.

Knit element 10 can be layered over and attached to a surface of substrate 130 in some embodiments. For example, knit element 10 can be attached to the front surface 131 of the substrate 130. Thus, knit element 10 can be exposed on an exterior of the upper 120. In other embodiments, knit element 10 can be included on the back surface 133 of substrate 130 to be inside upper 120. Furthermore, in some embodiments, upper 120 can be constructed from a plurality of members, and support member can be at least partially layered between the members.

Figure 5:
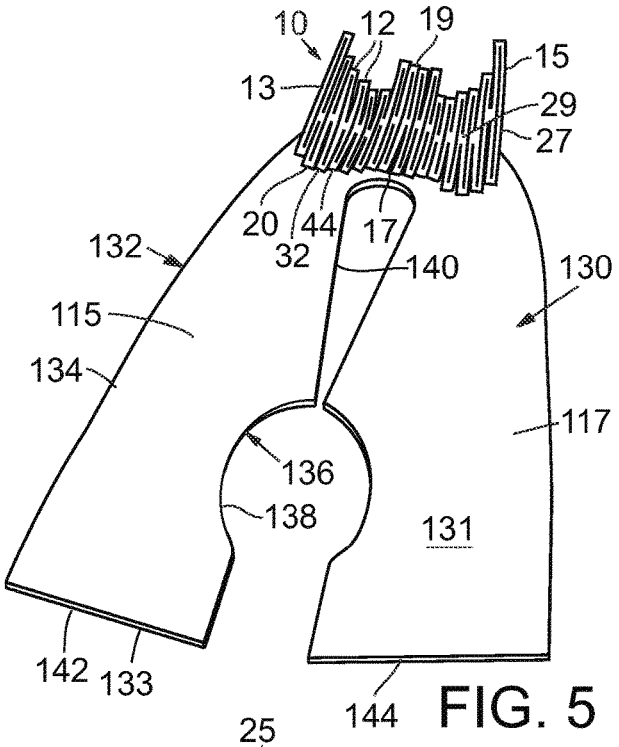
FIG. 5 is a perspective view of the knit element of FIG. 1 positioned relative to a substrate of an article of footwear.

As shown in FIG. 5, during assembly of the upper 120, knit element 10 can be positioned in forefoot region 111 of substrate 130. In the embodiment illustrated, for example, knit element 10 can be layered over substrate 130 with first surface 27 facing front surface 131 of substrate 130. Then, as shown in FIG. 6, knit element 10 can be expanded. For example, the first edge 13 can be pulled, causing the expansion components 12 to expand. More specifically, knit element 10 can be expanded along a curved path from forefoot region 111 along lateral side 115 of substrate 130. More specifically, as shown in FIG. 6, the knit element 10 can expand along a curved path, which rotates about the third axis 25 (i.e., the axis extending through the thickness of the knit element 10). Similarly, the second edge 15 can be pulled along an opposite curved path to expand the expansion components 12 along the lateral side 117 of substrate 130.

Figure 7:
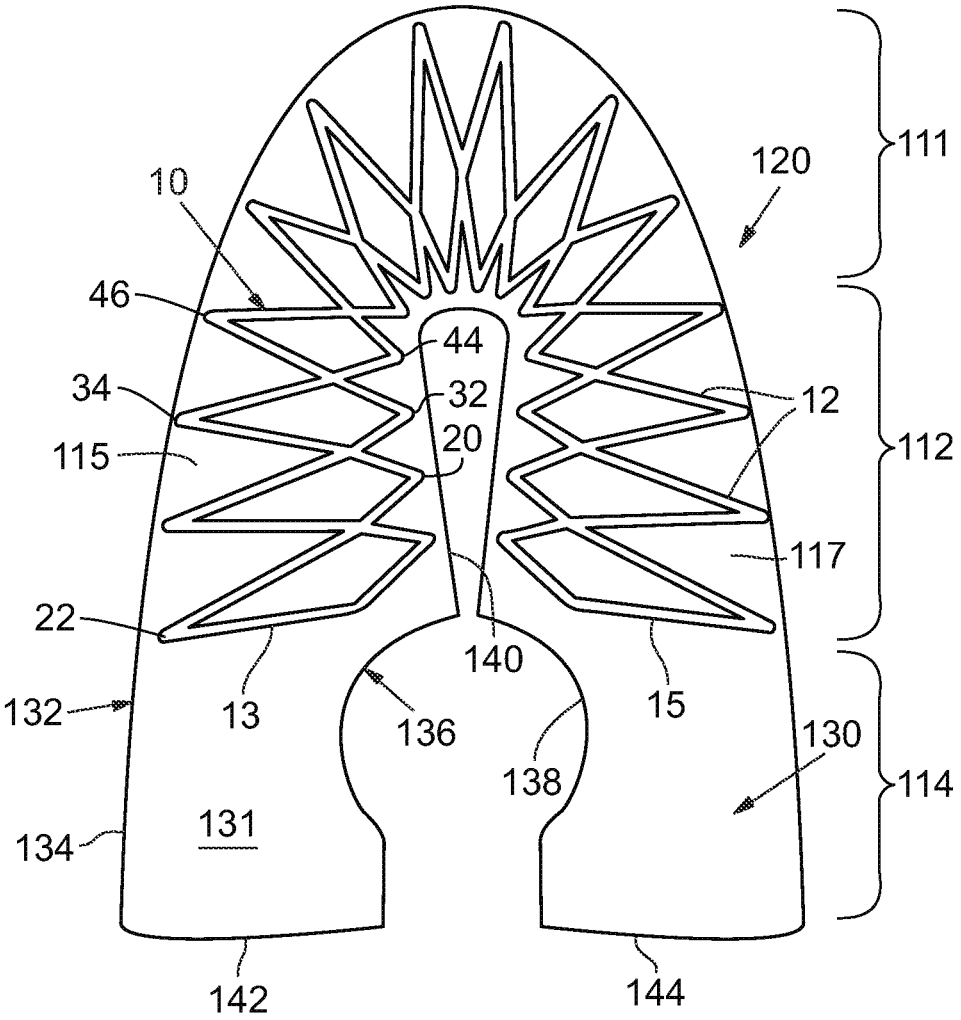
FIG. 7 is a plan view of the knit element and substrate of FIG. 6, wherein the knit element is in the expanded position and attached to the substrate according to exemplary embodiments.
Figure 8:
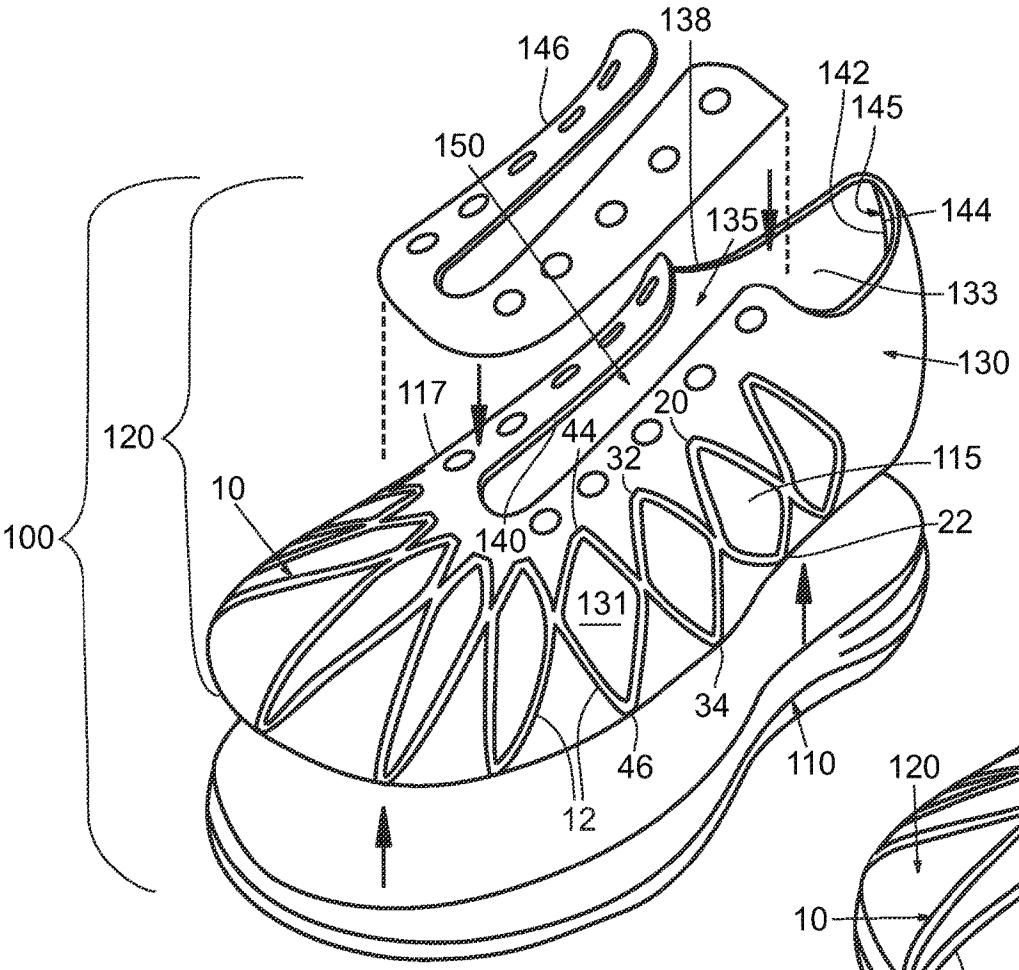
FIG. 8 is an exploded perspective view of the article of footwear, wherein the knit element and the substrate of FIG. 7 is shown being attached to a sole structure and a lacing element according to exemplary embodiments.

Accordingly, the row of expansion components 12 can extend from the medial side 117 of substrate 130, across the forefoot region 111, to the lateral side 115 as shown in FIG. 7. Furthermore, the first peripheral edge 13 can be disposed on lateral side 115, proximate the heel region 114, and the second peripheral edge 15 can be disposed on medial side 117, proximate the heel region 114. Also, in some embodiments, the first end junctions (e.g., first end junctions 20, 32, 44) of knit element 10 can be disposed proximate throat opening 140, and the second end junctions (e.g., second end junctions 22, 34, 46) of knit element 10 can be disposed proximate the outer peripheral edge 134.

Knit element 10 can be attached to substrate 130 while in the expanded position. Knit element 10 can be attached using adhesives, fasteners, sewing, or other implements.

The flexibility and expandability of knit element 10 can allow knit element 10 to layer smoothly across substrate 130. For example, in some embodiments, first surface 27 of knit element 10 can layer smoothly across substrate 130.

Then, as shown in FIG. 8, first heel edge 142 and second heel edge 144 can be joined at a seam 145 as illustrated in FIG. 8. Also, lacing element 146 can be attached at a throat 150 of upper 120. In some embodiments, lacing element 146 can be attached to cover over at least some of the first end junctions 20, 32, 44 of the knit element 10.

Furthermore, in some embodiments, sole structure 110 can be attached as shown in FIG. 8. In some embodiments, sole structure 110 can be attached to cover over outer peripheral edge 134 of substrate 130. Also, in some embodiments, sole structure 110 can be attached to cover at least some of the second end junctions 22, 34, 46 of knit element 10.

Therefore, as shown in FIGS. 9-11, upper 120 can include knit element 10, and knit element 10 can span like a web across forefoot region 111, lateral side 115, and medial side 117 of upper 120. Knit element 10 can support substrate 130 and resist stretching in predetermined directions in some embodiments. In additional embodiments, knit element 10 can protect substrate 130 and/or reinforce substrate 130. Knit element 10 can also conform to the wearer's foot and/or maintain the foot over the sole structure 110.

Additionally, in some embodiments, the expansion components 12 can be oriented in a way such that the expansion components 12 transfer and/or distribute forces across the upper 120 in a predetermined manner. For example, expansion components 12 can be oriented to extend along predetermined load paths within upper 120. Accordingly, knit element 10 can provide needed support to upper 120 and/or the wearer's foot.

Although the illustrated embodiments of upper 120 include knit element 10 shown extending from lateral side 115, across forefoot region 111, to medial side 117, it will be appreciated that knit element 10 can extend across other portions of upper 120 without departing from the scope of the present disclosure. For example, in some embodiments, knit element 10 can extend from lateral side 115, across heel region 114, to medial side 117. In additional embodiments, knit element 10 can extend substantially about the entire upper, from lateral side 115, across forefoot region 111, to medial side 117, to heel region 114, and back to lateral side 115. Furthermore, in some embodiments, knit element 10 can be disposed on lateral side 115 only. In still other embodiments, knit element 10 can be disposed on medial side 117 only.

Also, while upper 120 is shown with knit element 10 attached to substrate 130, it will be appreciated that upper 120 may not include the substrate 130. For example, in some embodiments, knit element 10 can independently define the majority of upper 120, leaving the wearer's foot exposed through the external openings 31 and/or the internal openings 33.

Referring now to FIGS. 1, 2, 3, 11, and 12, methods of forming knit element 10 will be discussed according to exemplary embodiments. As mentioned above, the knit element 10 can be formed via a knitting process. More specifically, in some embodiments, knit element 10 can be formed via a warp knitting process. For purposes of discussion, knit element 10 will be discussed below in detail as being formed via a warp knitting process. In other embodiments, knit element 10 can be formed via a weft knitting or other knitting process.

Figure 12:
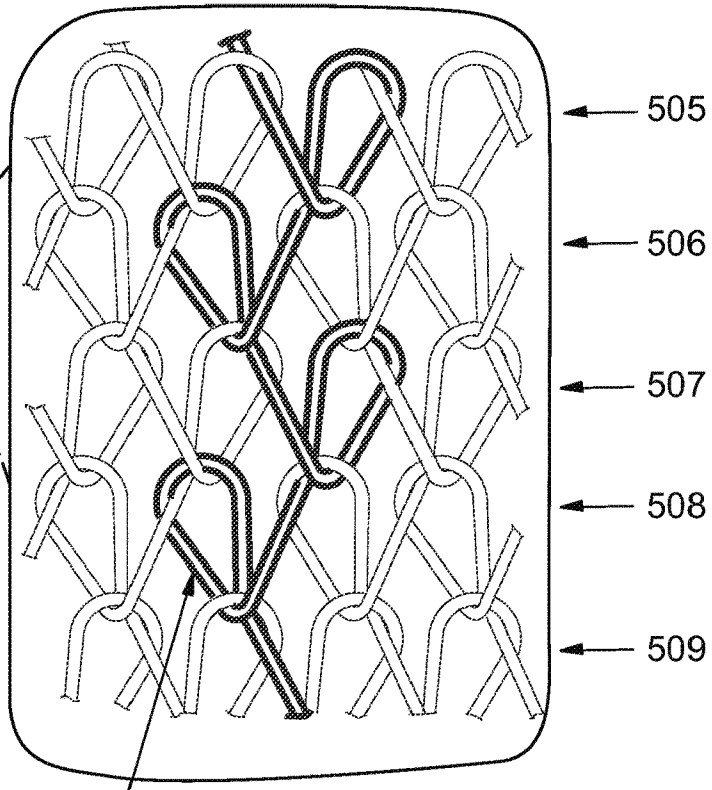
FIG. 12 is a detail view of a first portion of the knit element of FIG. 1.

Knit element 10 can define a warp direction, which can be substantially parallel to the second axis 23. Also, knit element 10 can define a weft direction, which can be substantially parallel to the first axis 21. As shown in FIG. 12, knit element 10 can be knitted from a plurality of knitted and interlooped yarns 500. One yarn 500 is highlighted in FIG. 12 for purposes of clarity. The yarns 500 can be interlooped to form a plurality of courses and wales of knit element 10. Specifically, a first course 505, a second course 506, a third course 507, a fourth course 508 and a fifth course 509 are shown as examples. Also, a first wale 501, a second wale 502, a third wale 503, and a fourth wale 504 are shown as examples. The courses 505, 506, 507, 508, 509 can extend generally in the weft direction along the first axis 21, and the wales 501, 502, 503, 504 can extend generally in the warp direction along the second axis 23.

As shown in FIG. 12, a single yarn 500 can extend across a plurality of courses, substantially along the second axis 23, and substantially in the warp direction. Also, the yarn 500 can zigzag between adjacent wales 504 as it extends generally along the second axis 23 in the warp direction. For example, as shown in the embodiment of FIG. 12, the yarn 500 can interloop with corresponding loops of the second wale 502 and the third wale 503.

A variety of knitting processes may be utilized to manufacture knit element 10 including, for example, tricot, raschel, and double needle-bar raschel (which further includes jacquard double needle-bar raschel). Also, knit element 10 can be knitted substantially automatically using a known knitting machine. Through this knitting process, knit element 10 can be knitted to include finished edges (e.g., edges that are configured to prevent unravelling).

The knitting process can be used to form knit element 10 as a unitary, one piece member. Stated differently, knit element 10 can be formed of unitary knit construction. As utilized herein, a knitted component (e.g., the textile element forming knit element 10) is defined as being formed of "unitary knit construction" when formed as a one-piece element through a knitting process. For example, a warp knitted component is defined as being formed of "unitary knit construction" when formed as a one-piece element through a warp knitting process. That is, the knitting process substantially forms the various features and structures of knit element 10 without the need for significant additional manufacturing steps or processes. A unitary knit construction may be used to form knit element 10 with structures or elements that include one or more courses of yarn, strands, or other knit material that are joined such that the structures or elements include at least one course or wale in common (i.e., sharing a common yarn), include areas that are interlooped with each other, and/or include areas that are substantially continuous between each of the structures or elements. With this arrangement, a one-piece element of unitary knit construction is provided.

Accordingly, the plurality of expansion components 12 of knit element 10 can be formed of unitary knit construction with each other. For example, the plurality of expansion components 12 can be formed of unitary knit construction via the plurality of intermediate junctions 35.

Also, one or more of the plurality of external openings 31 can be at least partially formed via the warp knitting process.

Likewise, one or more of the plurality of internal openings 33 can be at least partially formed via the warp knitting process.

By way of example, FIGS. 2 and 3 show that first strap member 28 can be knitted to include a first leading edge 51 and a first trailing edge 53. Also, second strap member 30 can be knitted to include a second leading edge 55 and a second trailing edge 57. Other strap members can be formed to include respective leading and trailing edges.

It will be noted that the terms "leading edge" and "trailing edge" in this context are merely used to differentiate edge 51 from edge 53 and to differentiate edge 55 from edge 57. These terms are not intended to imply that one edge is formed before the other during the knitting process. For example, first leading edge 51 can be formed before first trailing edge 53 in some embodiments. In other embodiments, first trailing edge 53 can be formed before first leading edge 51. Likewise, second leading edge 55 can be formed before second trailing edge 57 in some embodiments. In other embodiments second trailing edge 57 can be formed before second leading edge 55.

Figure 13:
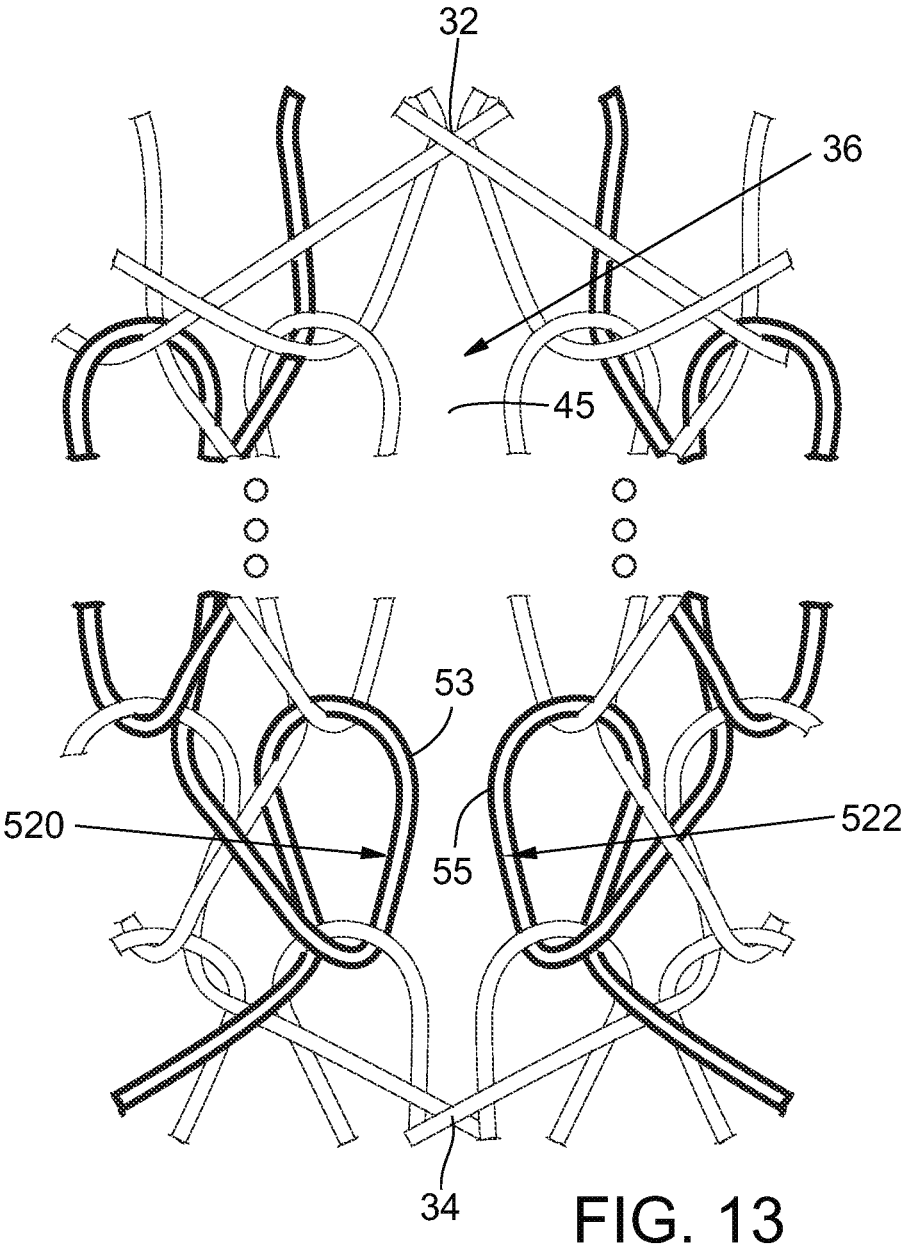
FIG. 13 is a detail view of a second portion of the knit element of FIG. 1.

As shown in FIGS. 2 and 13, the second internal opening 36 and, thus, the second internal slit 45 can be cooperatively defined by the first trailing edge 53 of the first strap member 28 and the second leading edge 55 of the second strap member 30. The first trailing edge 53 and the second leading edge 55 can extend from the first end junction 32 to the second end junction 34 in the warp direction, along the second axis 23. In some embodiments represented in FIG. 13, the first trailing edge 53 can be disposed away from the second leading edge 55 by a single wale of knit element 10, causing opening 36 to have a slit-like appearance.

Additionally, as shown in FIG. 13 the first trailing edge 53 and the second leading edge 55 can be defined by yarns during a warp knitting process. More specifically, as shown in FIG. 13, a first edge yarn 520 can be knitted to at least partially define the first trailing edge 53, and a second edge yarn 522 can be knitted to at least partially define the second leading edge 55. Stated differently, the first edge yarn 520 and the second edge yarn 522 are disconnected at predetermined areas to define the second internal opening 36 and, thus, the slit 45. Furthermore, first edge yarn 520, second edge yarn 522 and/or other yarns can be interlooped to form first end junction 32 and second end junction 34.

The knit element 10 can include other internal openings 33 that are also defined by respective leading and trailing edges. Likewise, the knit element 10 can include external openings 31 that are defined by respective edges. These edges can be formed via the knitting process in a manner similar to the first leading edge 51, first trailing edge 53, second leading edge 55, and second trailing edge 57.

Accordingly, knit element 10 can be formed of unitary knit construction, and the edges defining the internal openings 33 and/or external openings 31 can be formed via the knit process. Thus, knit element 10 can be manufactured efficiently and in a relatively short amount of time. Also, knit element 10 can be highly durable and can be unlikely to unravel or fray.

Additionally, the knit structure of knit element 10 can provide article of footwear 100 with one or more beneficial stretch characteristics in some embodiments. For example, the expansion components 12 can expand readily in the weft direction (along the first axis 21) as discussed above. In contrast, the strap members 51 of the expansion components 12 can be substantially non-extensible along the warp direction (along the second axis 23). Stated differently, the strap members 51 can resist stretching (i.e., can exhibit a high degree of stretch resistance) along the second axis 23. This non-extensibility can be a result of the knit structure of knit element 10 since a majority of the yarns generally extend in this warp direction along the second axis 23. Because of this characteristic, the knit element 10 can be oriented in a predetermined manner on the upper 120 such that the strap members 51 of the expansion components 12 provide desired stretch resistance.

Also, the knit element 10 can be disposed on the footwear 100 such that the warp direction is in a predetermined orientation relative to one or more additional structures of footwear 100. For example, as shown in FIGS. 9-11, the strap members of the expansion components 12 can extend longitudinally between the sole structure 110 and the throat 150 such that upper 120 substantially resists stretching between sole structure 110 and throat 150. As such, the warp direction of knit element 10 can be oriented generally between the sole structure 110 and the throat 150. As a result, the knit element 10 and the upper 120 can resist stretching between the sole structure 110 and the throat 150. Therefore, when the wearer pulls the shoelace 148 tight, the upper 120 can cinch against the wearer's foot and secure the footwear 100 to the foot.

Figure 14:
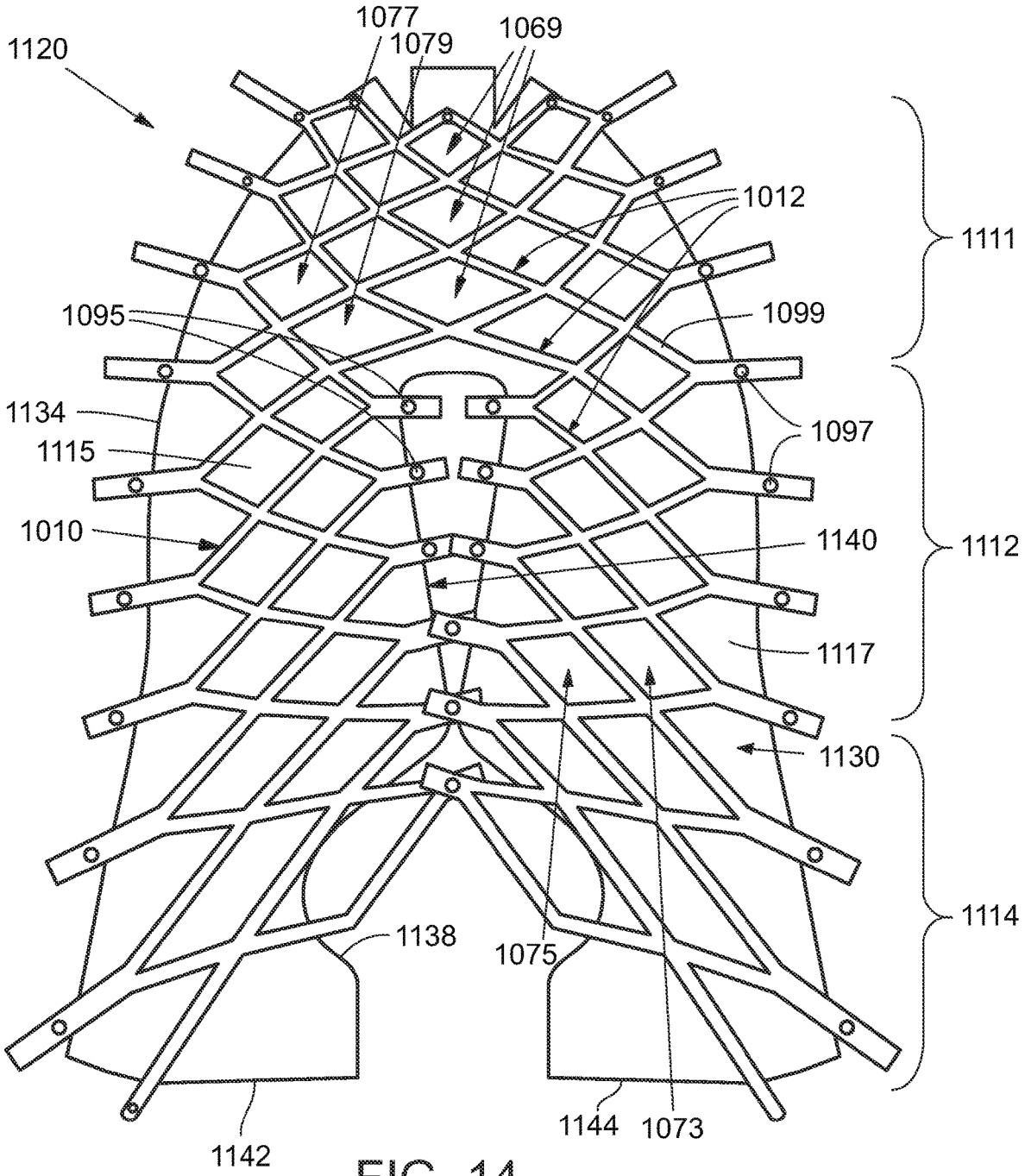
FIG. 14 is a plan view of an upper with a knit element according to additional exemplary embodiments.

Referring now to FIG. 14, additional embodiments of upper 1120 are illustrated. Upper 1120 can include knit element 1010, which can correspond to knit element 10 of FIGS. 1-13 except as noted. Features that correspond to the embodiments of FIGS. 1-13 are indicated with corresponding reference numbers increased by 1000.

As shown, knit element 1010 can include a plurality of central expansion components 1069. Central expansion components 1069 can be disposed in the forefoot region 1111. Knit element 1010 can expand from central expansion components 1069 to lateral side 1115 and medial side 1117.

For example, knit element 1010 can include a first lateral row 1077 of expansion components 1012 and a second lateral row 1079 of expansion components 1012. First lateral row 1077 can be disposed closer to outer peripheral edge 1134 than second lateral row 1079. Also, knit element 1010 can include a first medial row 1073 of expansion components 1012 and a second medial row 1075 of expansion components 1012. First medial row 1073 can be disposed closer to outer peripheral edge 1134 than second medial row 1075.

Also, as shown, knit element 1010 can extend within forefoot region 1111, midfoot region 1112, and heel region 1114 of upper 1120. Specifically, support 1010 can extend substantially from first heel edge 1142, along lateral side 1115, across forefoot region 1111, along medial side 1117, to second heel edge 1144.

Additionally, in some embodiments, knit element 1010 can include one or more apertures that can be used for indexing knit element 1010 relative to substrate 1012. For example, knit element 1010 can include outer indexing apertures 1097, which are proximate outer peripheral edge 1134. Knit element 1010 can also include inner indexing apertures 1095, which are proximate throat opening 1140. In some embodiments, inner and outer indexing apertures 1095, 1097 can be included in extended ends 1099 of knit element 1010. In some embodiments, knit element 1010 can be pinned or otherwise secured to a body using indexing apertures 1095, 1097 when attaching knit element 1010 to substrate 1130. In some embodiments, knit element 1010 can be pinned using indexing apertures 1095, 1097 when applying heat (i.e., steam) to the knit element 1010 and substrate 1130.

Figure 18:
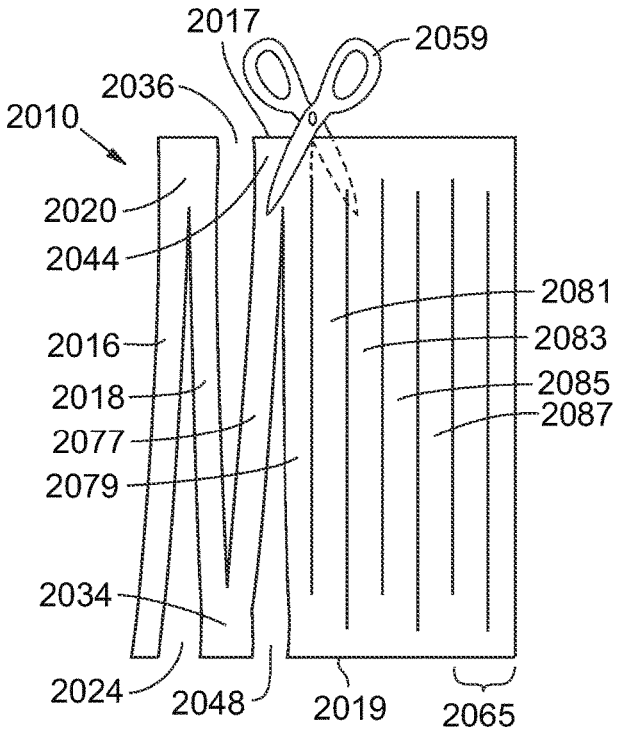
FIG. 18 is a plan view of the knit element of FIGS. 15 and 16, wherein strap members are shown in the process of being separated from each other according to exemplary embodiments.
Figure 19:
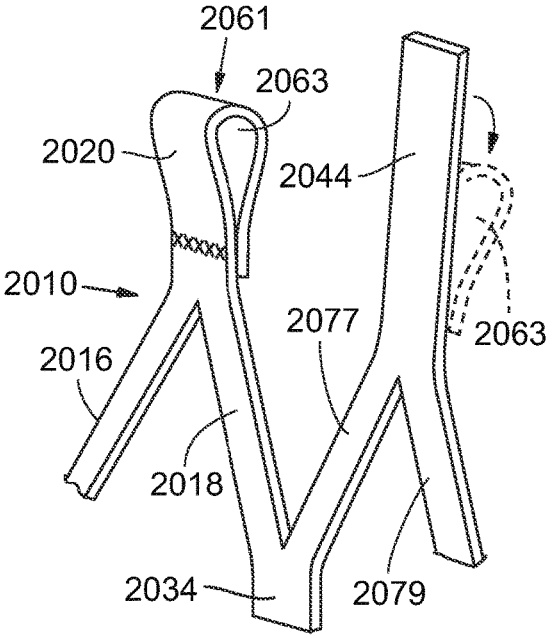
FIG. 19 is a perspective view of the knit element of FIG. 18, wherein a securement element is shown.
Figure 20:
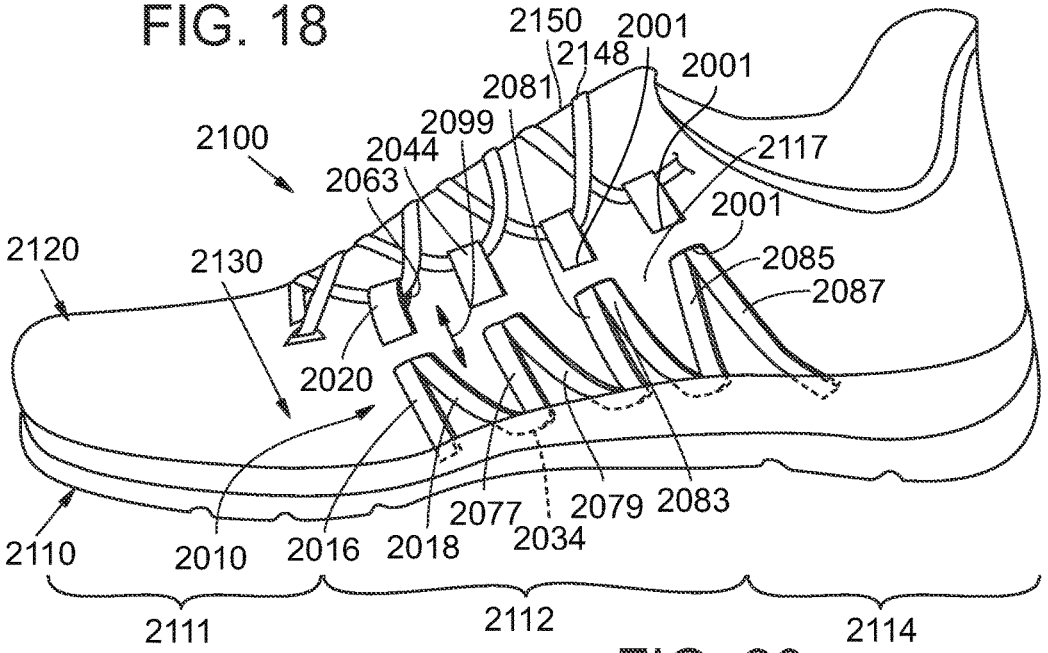
FIG. 20 is a medial side view of an article of footwear that includes the knit element of FIGS. 18-19.

Referring now to FIGS. 15-20, additional exemplary embodiments of knit element 2010 are illustrated. Knit element 2010 can form at least a portion of an upper 2120 of an article of footwear 2100 as shown in FIG. 20. Knit element 2010 can correspond to knit element 10 of FIGS. 1-13 except as noted. Features that correspond to the embodiments of FIGS. 1-13 are indicated with corresponding reference numbers increased by 2000.

Figure 15:
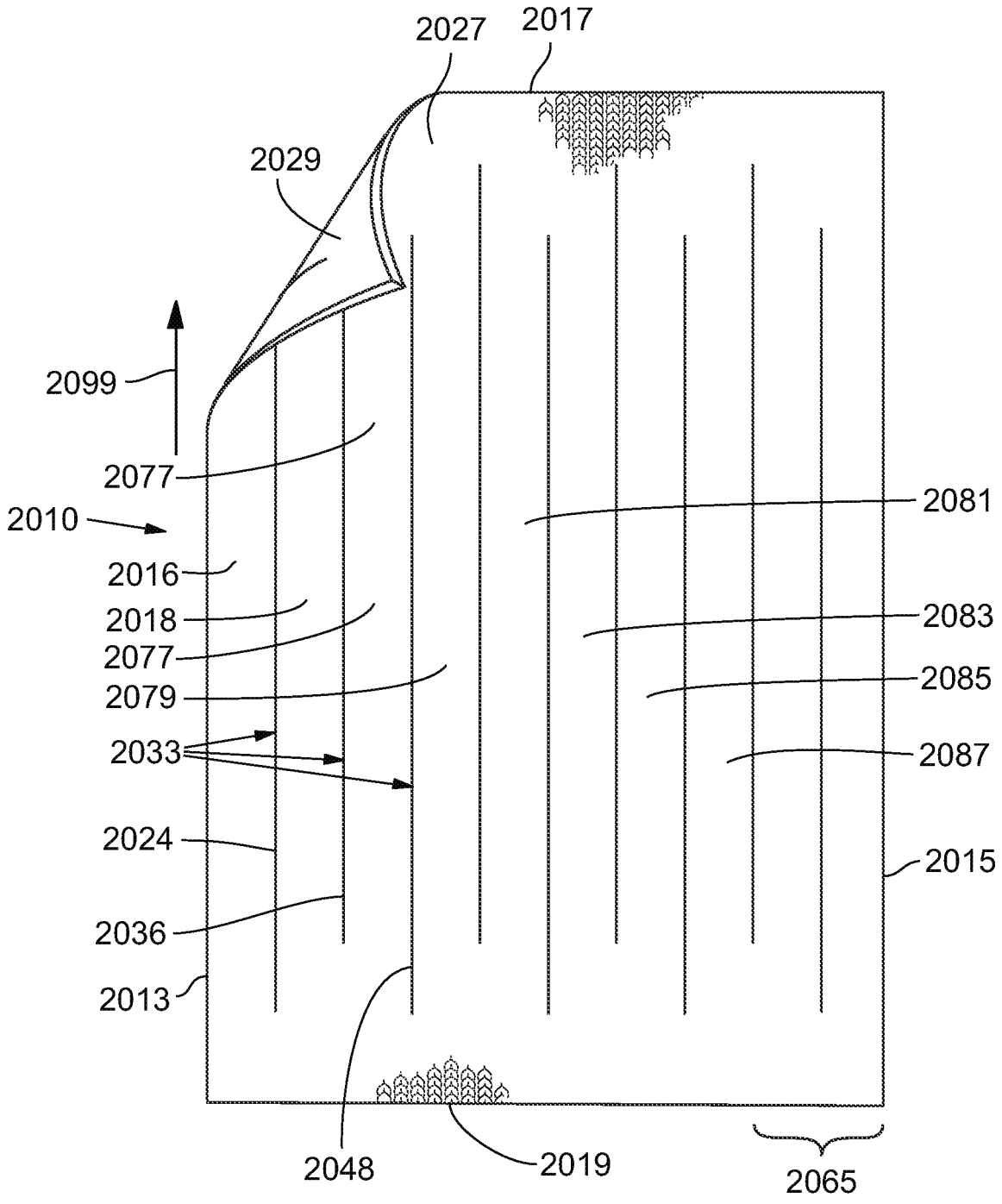
FIG. 15 is a plan view of a knit element according to additional exemplary embodiments.
Figure 16:
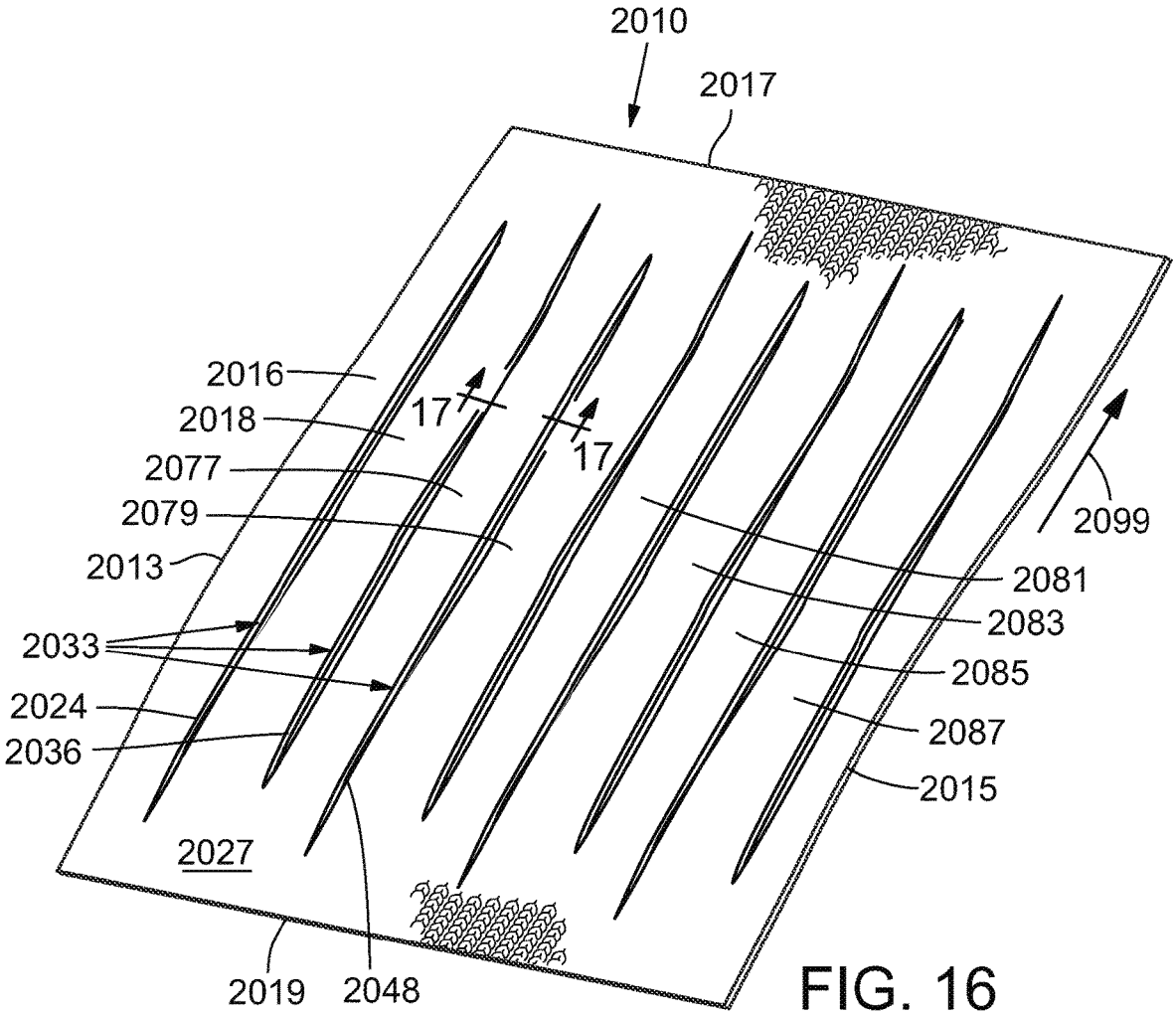
FIG. 16 is a perspective view of the knit element of FIG. 15.

As shown in FIGS. 15 and 16, knit element 2010 can include the plurality of internal openings 2033. The openings 2033 can be substantially parallel to the first peripheral edge 2013 and the second peripheral edge 2015. Also, the openings 2033 can extend longitudinally between the third peripheral edge 2017 and the fourth peripheral edge 2019 in the warp direction, which is indicated by arrow 2099 in FIGS. 15 and 16. Furthermore, the openings 2033 can be offset relative to each other along the warp direction 2099.

The openings 2033 can separate neighboring ones of the strap members of knit element 2010. For example, first strap member 2016, second strap member 2018, third strap member 2077, fourth strap member 2079, fifth strap member 2081, sixth strap member 2083, seventh strap member 2085, and eighth strap member 2087 are indicated in FIGS. 15 and 16. Also, the plurality of openings 2033 can include a first opening 2024, a second opening 2036, and a third opening 2048. First opening 2024 can separate the first strap member 2016 from the second strap member 2018. Second opening 2036 can separate the second strap member 2018 from the third strap member 2077. Third opening 2048 can separate the third strap member 2077 from the fourth strap member 2079. Additional openings are also illustrated that separate others of the strap members.

Figure 17:
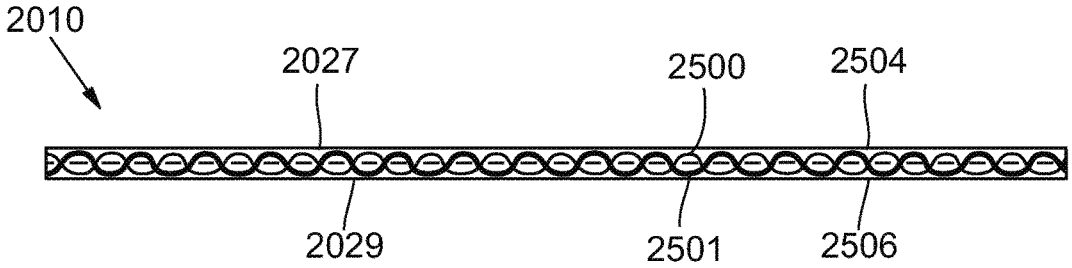
FIG. 17 is a cross sectional view of the knit element taken along the line 17-17 of FIG. 16.

Moreover, as shown schematically in the cross section of FIG. 17, knit element 2010 can be formed by multiple overlapping layers of knitted textile. For example, knit element 2010 can include a first layer 2504 that substantially defines the first surface 2027 of knit element 2010. Also, knit element 2010 can include a second layer 2506 that substantially defines the opposing second surface 2029 of knit element 2010. Stated differently, the first layer 2504 can be formed by knitted first yarns 2500, and the second layer 2506 can be defined by knitted second yarns 2501.

As shown, the first layer 2504 and the second layer 2506 can be overlapped. Also, in some embodiments, the first yarn(s) 2500 of the first layer 2504 can be interlooped with the second yarn(s) 2501 of the second layer 2506 such that the first and second layers 2504, 2506 are attached and formed of unitary knit construction. Thus, areas in which first and second layer 2504, 2506 are overlapping and interlooped together can be referred to as "interlooped overlapping areas" of knit element 2010. In some embodiments, the first layer 2504 and the second layer 2506 can be interlooped and overlapped between the openings 2033 in knit element 2010. Specifically, FIG. 17 illustrates that the layers 2504, 2056 can be interlooped and overlapped across the third strap member 2077 from the second opening 2036 to the third opening 2048. It will be appreciated that the other strap members can be similarly formed. Also, in some embodiments, the first layer 2504 and the second layer 2506 can be interlooped and overlapping across substantially the entire knit element 2010.

In some embodiments, the first yarns 2500 of first layer 2504 can be different from the second yarns 2501 of second layer 2506. Accordingly, the yarns 2500 defining first side 2027 can be different from yarns 2501 defining second side 2029. Thus, knit element 2010 can be manufactured to have different configurations on first side 2027 and second side 2029.

For example, in some cases, the first side 2027 and second side 2029 can have different knitting patterns, and/or differences in knitted structures. Also, the yarns 2500, 2501 can be made from different materials, can exhibit different stretch characteristics, can differ in color, can differ in softness, can differ in denier, or can otherwise differ. Additionally, in some embodiments, the first side 2027 can exhibit a greater degree of durability, strength, and/or wear or abrasion resistance than second side 2029 of knit element 2010. With a desired selection of knitting configurations for each of side of knit element 2010, desired characteristics may be selectively provided to the upper.

Formation of the knit element 2010 and incorporating knit element 2010 into an article of footwear 2100 will now be discussed. Like the embodiments discussed above, knit element 2010 can be formed of unitary knit construction via a knitting process, such as a warp knitting process. As shown in FIGS. 15 and 16, knit element 2010 can be initially formed such that the openings 2033 stop short of the third peripheral edge 2017 and the fourth peripheral edge 2019.

Subsequently, as shown in FIG. 18, a cutting tool 2059 (e.g., scissors, knife, laser cutter, cutting die, etc.) can be used to cut knit element 2010. In some embodiments, the cutting tool 2059 can be used to extend some of the openings 2033 to the third peripheral edge 2017 and to extend others to the fourth peripheral edge 2019. For example, cutting tool 2059 can be used to extend the first and third openings 2024, 2048 to the fourth peripheral edge 2019. Also, cutting tool 2059 can be used to extend the second opening 2036 to the third peripheral edge 2017. Other openings can be cut similarly. As such, the strap members of knit element 2010 can be further separated from each other. For example, the adjacent strap members can expand away from each other in the weft direction in a zigzagging arrangement as shown in the embodiment of FIG. 18. It should be noted, however, that adjacent strap members can remain joined and formed of unitary knit construction at predetermined areas. For example, first strap member 2016 can be joined to second strap member 2018 at first end junction 2020. Likewise, second strap member 2018 can be joined to third strap member 2077 at second end junction 2034. Moreover, third strap member 2077 can be joined to fourth strap member 2079 at first end junction 2044.

Also, in some embodiments, the cutting tool 2059 can be used to remove a predetermined number of the strap members from a bulk portion 2065 of knit element 2010. For example, in some embodiments, eighth strap member 2087 of knit element 2010 can be separated completely from the bulk portion 2065.

Next, as shown in FIG. 19, a securement element 2061 can be formed from knit element 2010. Generally, the securement element 2061 can enable a shoelace, a strap, a cable, a hook, or other securement device of the footwear 2100 to attach to the knit element 2010. In the embodiment of FIG. 19, for example, the securement element 2061 can be formed by overlapping each of the first end junction 2020 and first end junction 2044 on itself to form a receiving element 2063. The receiving element 2063 can receive a shoelace 2148 in some embodiments. Other first end junctions can also be similarly formed to form respective receiving elements 2063. The receiving elements 2063 can be secured in place using stitching, adhesives, fasteners, hook-and-loop tape, or other attachments.

Then, as shown in FIG. 20, knit element 2010 can be incorporated into the article of footwear 2100. For example, in the embodiment shown, knit element 2010 can be disposed on the medial side 2117 of the upper 2120. More specifically, in some embodiments, knit element 2010 can extend in the midfoot region 2112 on the medial side 2117 to support the wearer's arch, for example.

Also, knit element 2010 can secure the shoelace 2148 or other securement device of the footwear 2100. In some embodiments, shoelace 2148 can be received within the loops 2063 of the knit element 2010. Thus, tightening the shoelace 2148 can pull on and increase tension forces in the knit element 2010.

In some embodiments, strap members 2016, 2018, 2077, 2079, 2081, 2083, 2085, 2087 can extend generally between the sole structure 2110 and the throat 2150. In some embodiments, sole structure 2110 can attach to and overlap or otherwise conceal the second end junctions, such as second end junction 2034 as shown in FIG. 20.

Furthermore, in some embodiments, one or more strap members 2016, 2018, 2077, 2079, 2081, 2083, 2085, 2087 can be received within the substrate 2130. For example, as illustrated in FIG. 20, the substrate can include one or more apertures 2001. The apertures 2001 can receive one or more strap members 2016, 2018, 2077, 2079, 2081, 2083, 2085, 2087. As shown in the embodiment of FIG. 20, there can be four apertures 2001 so that each of the strap members extends through the substrate 2130. Also, the first end junctions (e.g., junctions 2020, 2044) can be exposed proximate throat 2150 to receive shoelace 2148.

Additionally, the strap members 2016, 2018, 2077, 2079, 2081, 2083, 2085, 2087 can be expanded away from each other such that knit element 2010 can fan out across the midfoot region 2112 on medial side 2117. Furthermore, knit element 2010 can be oriented such that the warp direction 2099 of the knit element 2010 is directed substantially between the throat 2150 and the sole structure 2110. Accordingly, the strap members can substantially resist stretching forces and the strap members can transfer forces between the throat 2150 and the sole structure 2110. Moreover, in some embodiments, the strap members can pull the upper 2120 and/or sole structure 2110 against the arch of the wear's foot for improving arch support.

Figure 21:
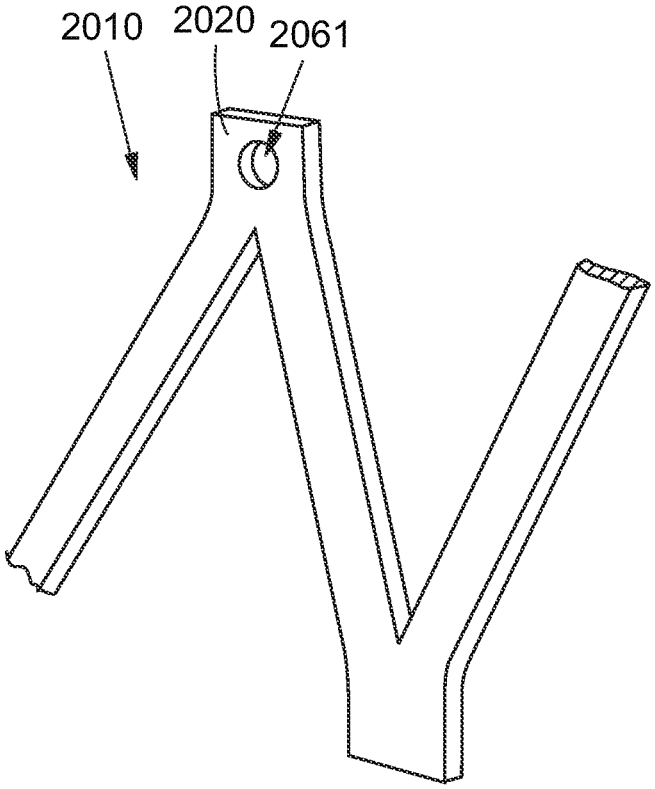
FIG. 21 is a perspective view of the knit element of FIGS. 18-19 with a securement element according to additional embodiments.

Referring now to FIG. 21, an additional embodiment of the knit element 2010 of FIGS. 15-20 is illustrated. In some embodiments, the securement element 2061 can include an eyelet. The eyelet can extend through one or more first end junctions 2020 such that the shoelace (not shown) or other securement device can attach to knit element 2010. In some embodiments, the edges that define the eyelet can be formed through the knitting process.

Figure 22:
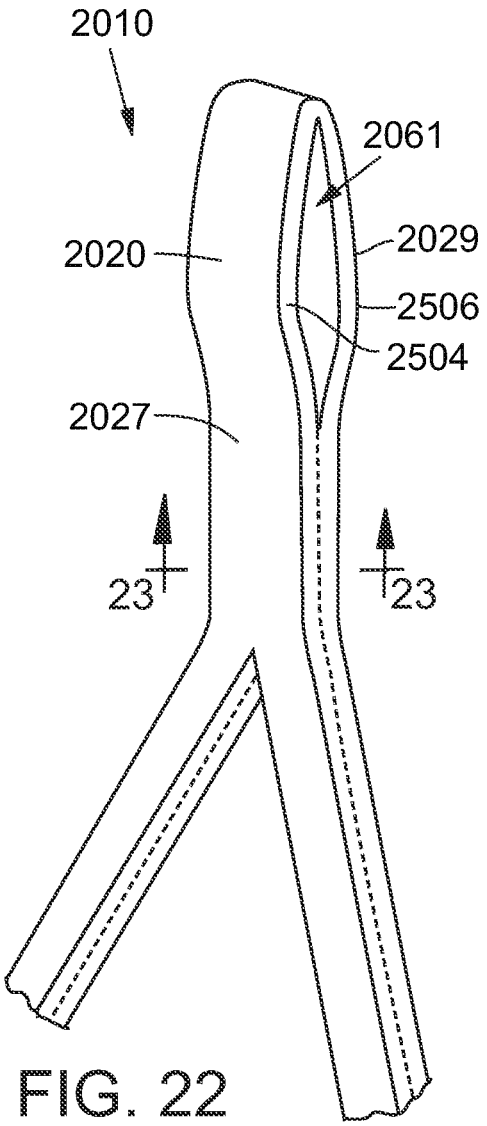
FIG. 22 is a perspective view of the knit element of FIGS. 18-19 according to additional embodiments.

Referring now to FIG. 22, an additional embodiment of the knit element 2010 of FIGS. 15-20 is illustrated. In some embodiments, the securement element 2061 can be formed between the first layer 2504 and the second layer 2506 of the knit element 2010. As shown in FIG. 22, for example, first layer 2504 and second layer 2506 can be interlooped together and connected on lower parts of knit element 2010; however, first layer 2504 and second layer 2506 can be overlapped but disconnected proximate first end junction 2020.

Figure 23:
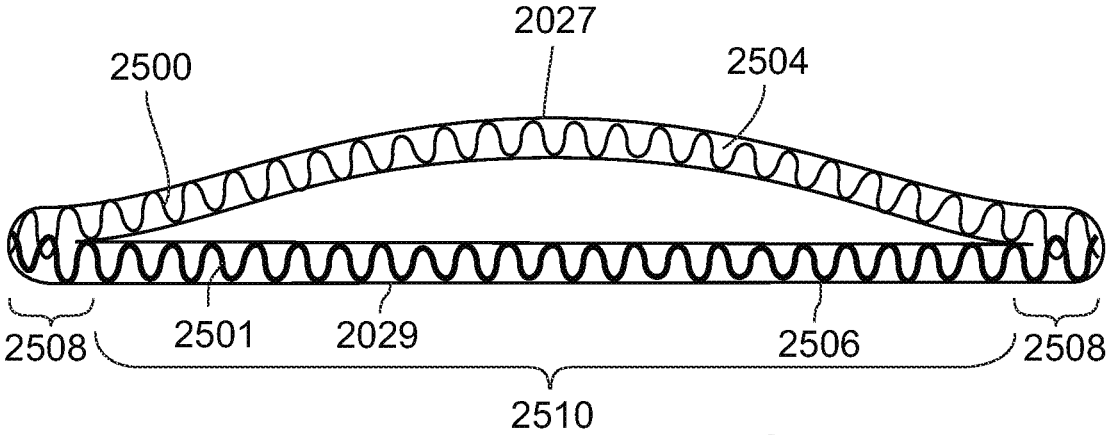
FIG. 23 is a cross sectional view of the knit element taken along the line 23-23 of FIG. 22.

Additionally, as shown in the section view of FIG. 23, the lower parts of knit element 2010 can include first layer 2504 and second layer 2506 in an overlapping configuration. As shown, first layer 2504 and second layer 2506 can be formed of unitary knit construction at one or more interlooped overlapping areas 2508. For example, in some embodiments, the knit element 2010 can include interlooped overlapping areas 2508 at the edges (i.e., between the leading and trailing edges) of knit element 2010. Also, first layer 2504 and second layer 2506 can be detached at one or more detached overlapping areas 2510. The detached overlapping areas 2510 can be defined between the connected edges (i.e., between the leading and trailing edges) of knit element 2010 in some embodiments.

Figure 24:
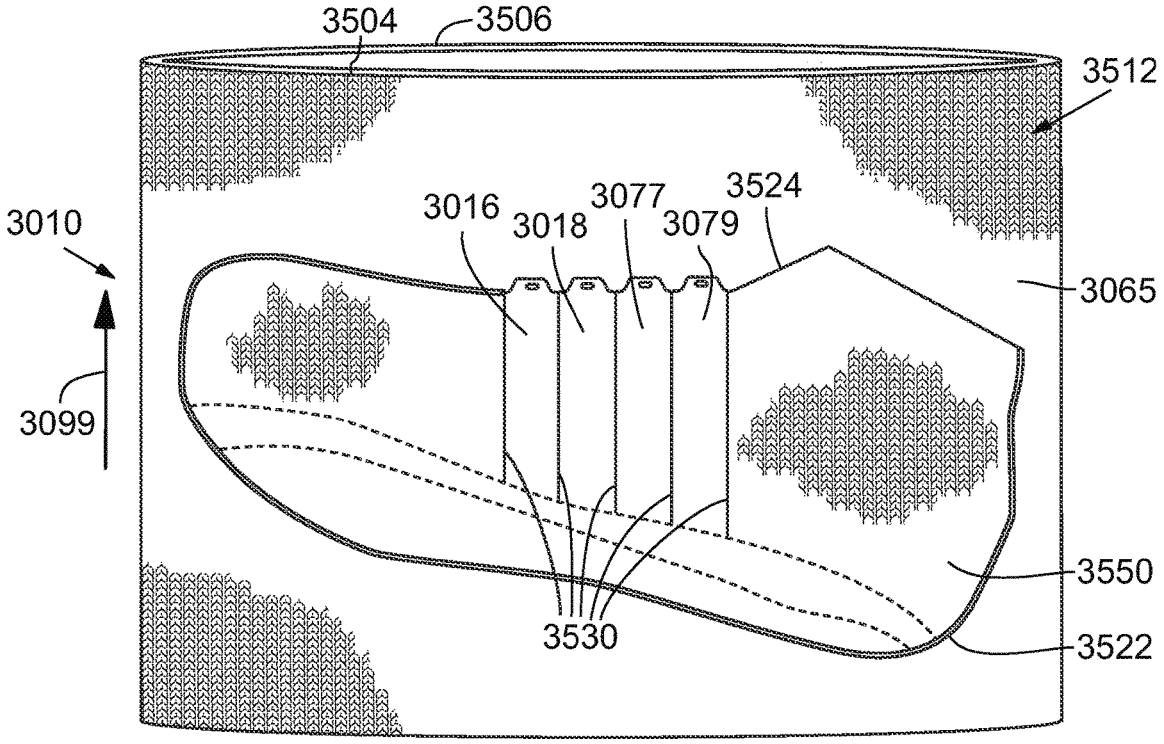
FIG. 24 is a schematic plan view of a knit element according to additional exemplary embodiments.
Figure 25:
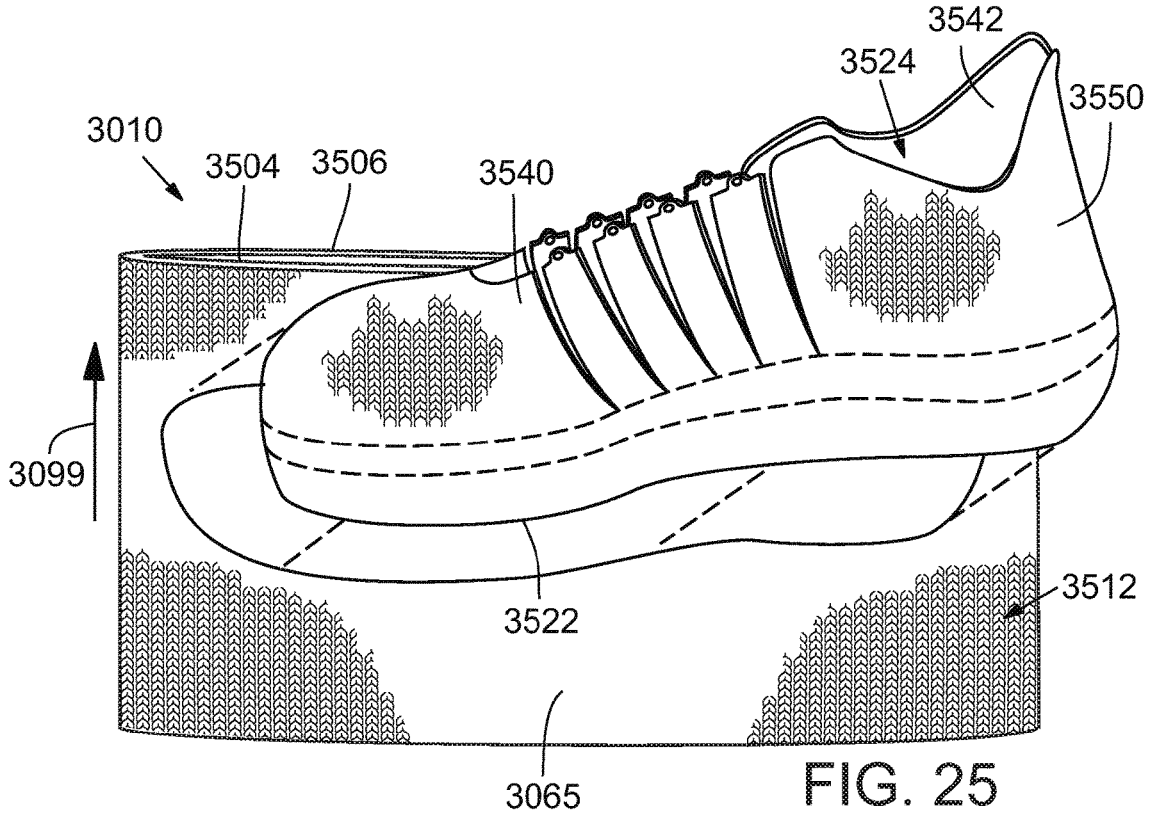
FIG. 25 is a schematic plan view of a footwear portion of the knit element of FIG. 24 being removed from a bulk portion.
Figure 26:
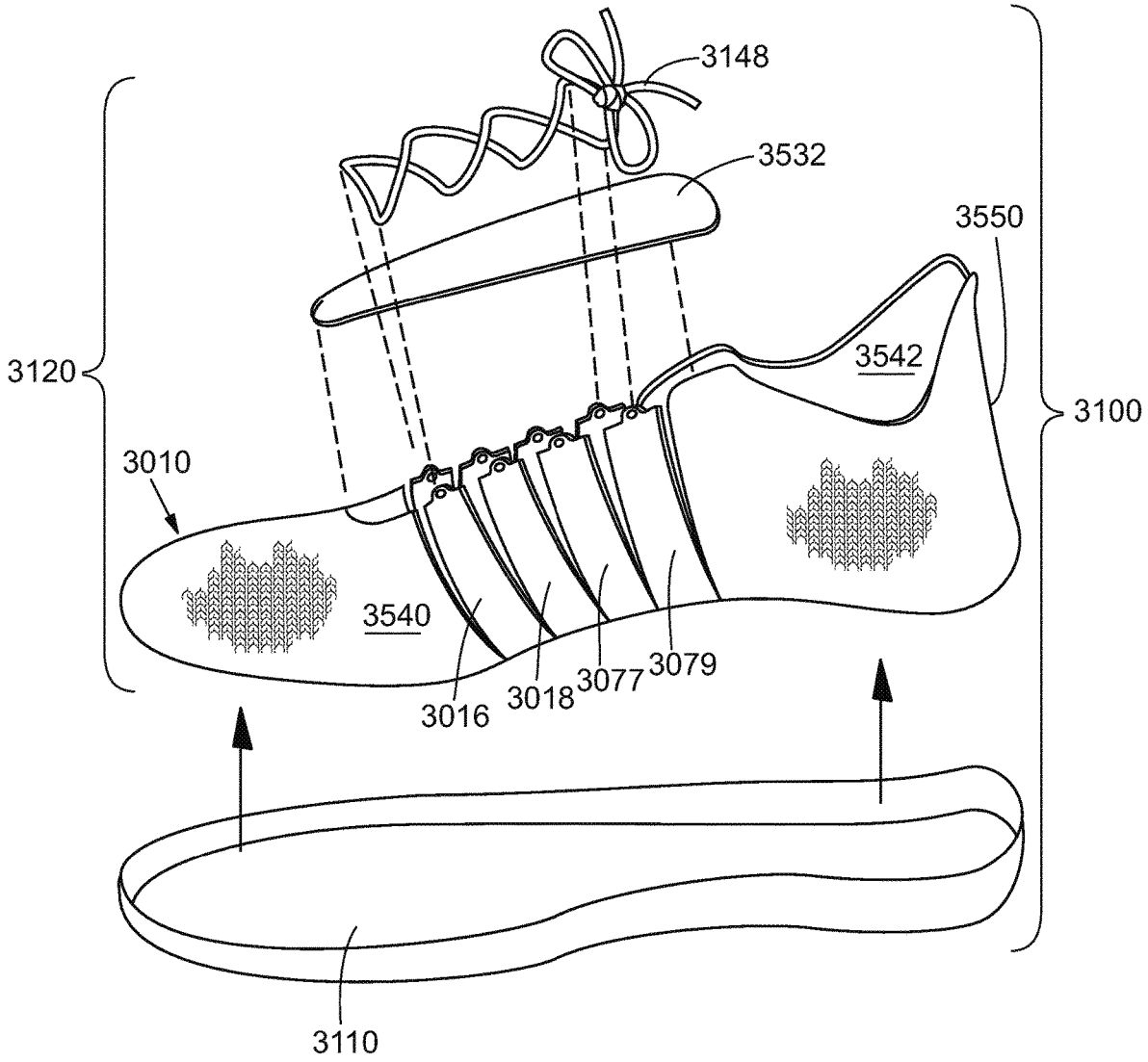
FIG. 26 is an exploded view of an article of footwear, which includes the footwear portion of the knit element of FIG. 25.

Referring now to FIGS. 24-26, additional exemplary embodiments of knit element 3010 are illustrated. Knit element 3010 can form at least a portion of an upper 3120 of an article of footwear 3100 as shown in FIG. 26. Knit element 3010 can correspond to knit element 10 of FIGS. 1-13 except as noted. Features that correspond to the embodiments of FIGS. 1-13 are indicated with corresponding reference numbers increased by 3000.

As shown in FIG. 24, knit element 3010 can be a warp knitted article with multiple overlapping layers. For example, knit element 3010 can include first layer 3504 and second layer 3506, which can be overlapped and formed of unitary knit construction. The first layer 3504 and second layer 3506 can be joined at predetermined areas. As shown in FIG. 24, for example, first layer 3504 and second layer 3506 can be joined at the edges to form a tubular textile element 3512. The warp direction 3099 can be substantially parallel to the joined edges of the tubular textile element 3512 in some embodiments.

Also, in some embodiments represented in FIG. 24, knit element 3010 can be knitted to include a bulk portion 3065 and a footwear portion 3550. First layer 3504 and second layer 3506 can cooperate to define bulk portion 3065 and footwear portion 3550. In some embodiments represented in FIG. 25, footwear portion 3550 can be removed from bulk portion 3065 to form at least part of an upper 3120 of the article of footwear 3100. Once removed from bulk portion 3065, the footwear portion 3550 can form at least part of an upper 3120 of the article of footwear 3100 as illustrated in FIG. 26.

In the embodiments of FIG. 24-26, footwear portion 3550 of knit element 3010 can form a majority of the upper 3120. For example, footwear portion 3550 can form a bootie that receives the wearer's foot. Thus, in some embodiments represented in FIGS. 24 and 25, footwear portion 3550 can include one or more interlooped areas 3522, where the first layer 3504 and the second layer 3506 are joined together via knitted and interlooped yarns. These interlooped areas 3522 can define a periphery of footwear portion 3550 in some embodiments. Other areas of footwear portion 3550 can include detached areas 3524, where the first layer 3504 and the second layer 3506 are detached. The detached areas 3524 can be included where the footwear portion 3550 is configured to receive the wearer's foot.

As shown in FIG. 24, footwear portion 3550 of knit element 3010 can additionally include one or more strap members 3016, 3018, 3077, 3079, which are separated by a plurality of slits 3530. As discussed above, the slits 3530 and the strap members 3016, 3018, 3077, 3079 can be formed substantially parallel to the warp direction 3099.

As shown in FIG. 25, once footwear portion 3550 is removed from bulk portion 3065, footwear portion 3550 can be expanded such that the strap members 3016, 3018, 3077, 3079 can move relative to each other along the slits 3530. Then as shown in FIG. 26, a sole structure 3110, a tongue 3532, and a shoelace 3148 or other securement device can be attached to footwear portion 3550.

It will be appreciated that, in some embodiments, footwear portion 3550 of knit element 3010 can define an external surface 3540 and an internal surface 3542 of the upper 3120 of the article of footwear 3100. The internal surface 3542 can define a cavity that receives the wearer's foot, and the external surface 3540 can face opposite the internal surface 3542.

In some embodiments, knit element 3010, footwear portion 3550, and/or footwear 3100 can correspond to those discussed in U.S. Patent Publication No. 2014/0352173, filed May 31, 2013, U.S. patent application Ser. No. 14/292,050, filed May 30, 2014, and/or U.S. patent application Ser. No. 14/292,181, filed May 30, 2014, the disclosure of each being incorporated herein by reference in its entirety.

Thus, the knit element 3010 and the article of footwear 3100 of FIGS. 24-26 can be formed in an efficient manner. Moreover, the strap members 3016, 3018, 3077, 3079 can be formed to resist stretching because they are formed to extend along the warp direction 3099.

Figure 31:
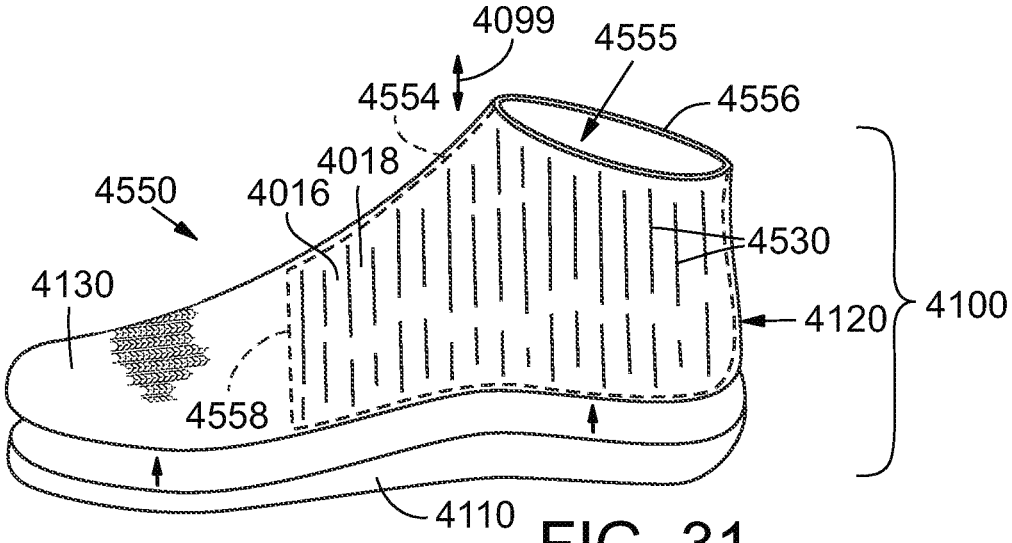
FIG. 31 is an exploded view of an article of footwear, which includes the footwear portion of the knit element of FIG. 30.

Referring now to FIGS. 27-31, additional exemplary embodiments of knit element 4010 are illustrated. Knit element 4010 can form at least a portion of an upper 4120 of an article of footwear 4100 as shown in FIG. 31. Knit element 4010 can correspond to knit element 3010 of FIGS. 24-26 except as noted. Features that correspond to the embodiments of FIGS. 24-26 are indicated with corresponding reference numbers increased by 1000.

As shown, knit element 4010 can include bulk portion 4065 and footwear portion 4550, which can be removed from bulk portion 4065. In some embodiments, footwear portion 4550 can include substrate 4130. Substrate 4130 and reinforcement component 4554 can be formed of unitary knit construction and can be joined at a junction 4556.

As will be discussed, reinforcement component 4554 can be used to reinforce the substrate 4130. In some embodiments, reinforcement component 4554 can be overlaid on predetermined portions of substrate 4130. For example, in some embodiments, reinforcement component 4554 can be overlaid on an internal surface of substrate 4130. In other embodiments, reinforcement component 4554 can be overlaid on an external surface of substrate 4130.

In some embodiments, substrate 4130 can form a bootie-like component which defines a cavity 4555 (FIGS. 30-31) configured to receive a foot. Also, in some embodiments, reinforcement component 4544 can be substantially tubular and can include an open end 4558, which is disposed opposite the junction 4556.

Figure 27:
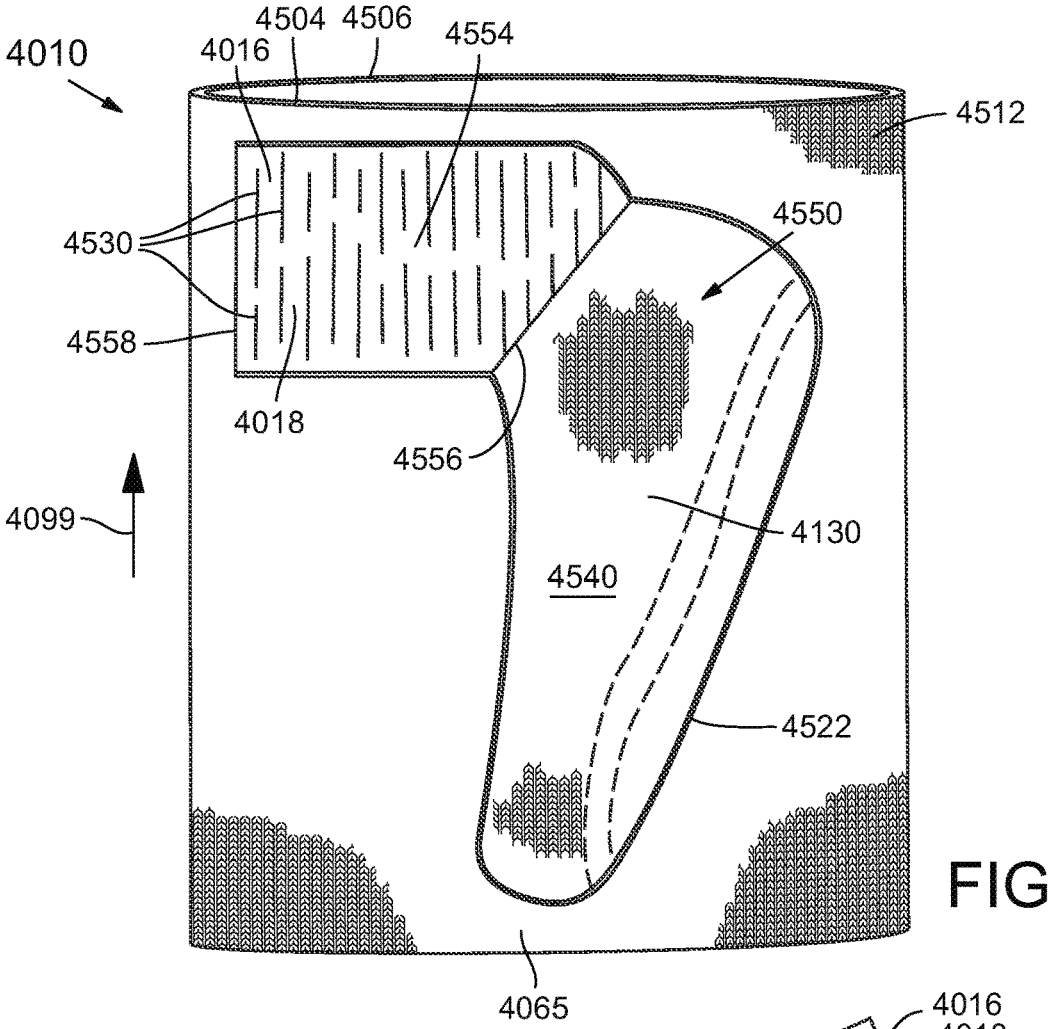
FIG. 27 is a schematic plan view of a knit element according to additional embodiments of the present disclosure.
Figure 28:
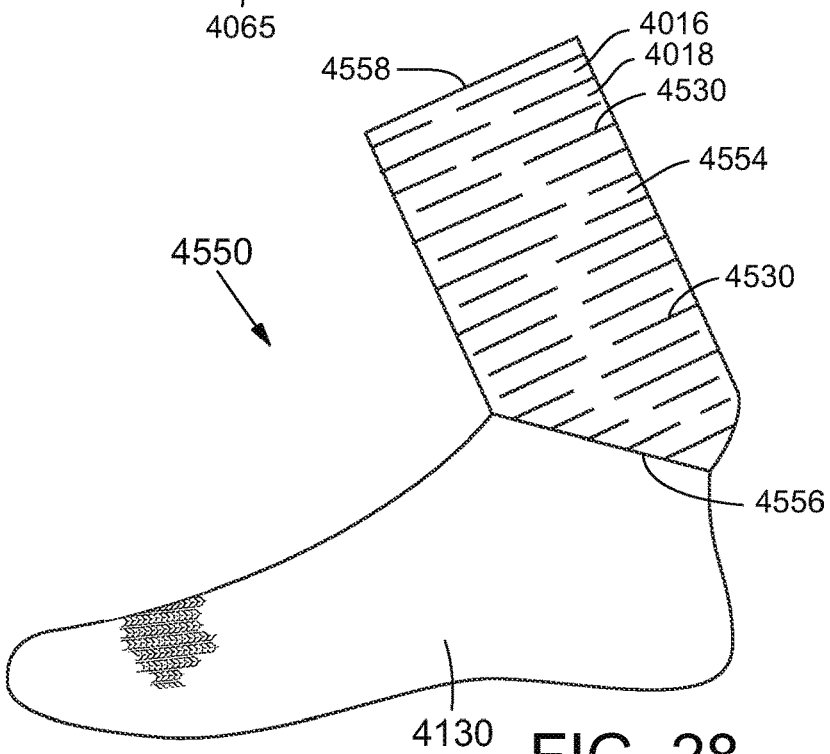
FIG. 28 is a schematic plan view of a footwear portion of the knit element of FIG. 27.
Figure 29:
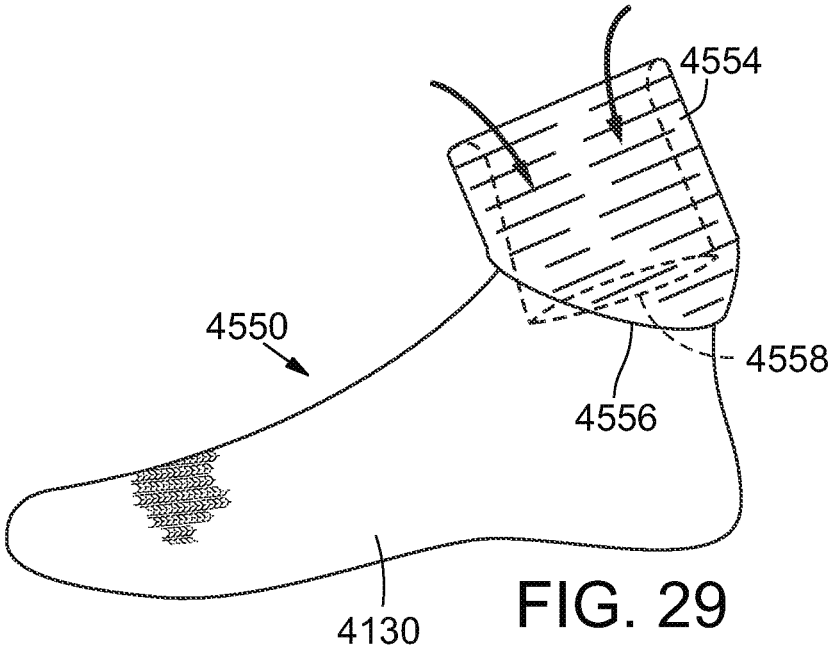
FIG. 29 is a schematic view of the footwear portion of the knit element of FIG. 28 shown while a reinforcing component is being tucked inside a substrate of the footwear portion.
Figure 30:
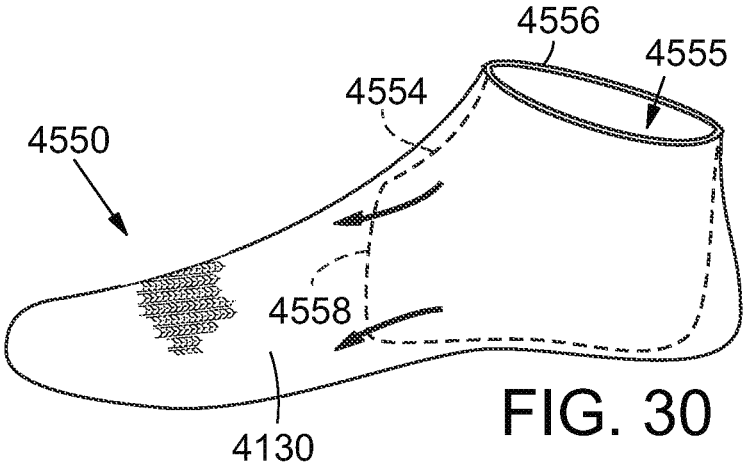
FIG. 30 is a schematic view of the footwear portion of the knit element of FIG. 29 shown with the reinforcing component being tucked further inside the substrate.

Also, as shown in FIG. 27, reinforcement component 4544 can include a plurality of slits 4530. The slits 4530 can be substantially parallel to the warp direction 4099, similar to the embodiments discussed above. The slits 4530 can separate areas of the reinforcement component 4544 into a plurality of strap members, such as the strap member 4016 and the strap member 4018 indicated in FIGS. 27 and 28. Thus, the strap members 4016, 4018 can extend longitudinally generally along the warp direction 4099.

Once the knit element 4010 is knitted (FIG. 27), the footwear portion 4550 can be removed from bulk portion 4065. Then, as shown in FIGS. 28-31, the reinforcement component 4554 can be inverted (i.e., turned inside out) and tucked inside the cavity 4555 of substrate 4130. In some embodiments, reinforcement component 4554 can remain formed of unitary knit construction with substrate 4130 when tucked inside the cavity 4555.

Next, as shown in FIG. 31, a sole structure 4110 can be attached. For example, in some embodiments, sole structure 4110 can be attached to substrate 4130 with reinforcement component 4554 tucked inside substrate 4130. In other embodiments, reinforcement component 4554 can be overlaid on an outer surface of substrate 4130, and sole structure 4110 can be attached such that sole structure 4110 overlaps a portion of reinforcement component 4554.

As shown in FIG. 31, once the reinforcement component 4554 is fully tucked inside substrate 4130, the strap members 4016, 4018 and slits 4530 can be disposed in a predetermined orientation relative to substrate 4130. For example, in some embodiments, the strap members 4016, 4018 and slits 4530 can extend in a vertical direction generally between the sole structure 4110 and the throat 4150 of the upper 4120. Stated differently, the reinforcement component 4554 can be positioned such that the warp direction 4099 of the reinforcement component 4554 is oriented in a predetermined orientation relative to the substrate 4130. In the embodiment of FIG. 31, for example, the warp direction 4099 of the reinforcement component 4554 can extend in a vertical direction between the sole structure 4110 and the throat 4150. Thus, the strap members 4016, 4018 can exhibit a high degree of stretch resistance between the sole structure 4110 and the throat 4150.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims. Moreover, as used in the claims "any of" when referencing the previous claims is intended to mean (i) any one claim, or (ii) any combination of two or more claims referenced.

We claim:

1. An article of footwear comprising:

a sole structure; and an upper that includes an expanded warp knit element that extends from the sole structure to a lacing region of the upper, the warp knit element being formed of a unitary knit construction and comprising a plurality of multi-sided cell structures including a first side, a second side, a third side, and a fourth side, wherein each cell structure comprises a bottom junction at the sole structure, a top junction at the lacing region, a first side junction, and a second side junction spaced apart from the first side junction, and wherein the first side extends from the bottom junction to the first side junction, the second side extends from the first side junction to the top junction, the third side extends from the top junction to the second side junction, and the fourth junction extends from the second side junction to the bottom junction.

2. The article of footwear of claim 1, wherein adjacent cell structures of the plurality of multi-sided cell structures are connected at an intersection of the first side junction of one cell structure and a second side junction of another, adjacent cell structure.

3. The article of footwear of claim 1, wherein the plurality of multi-sided cell structures define substantially quadrilateral shapes.

4. The article of footwear of claim 1, wherein the plurality of multi-sided cell structures extend along a toe region of the article of footwear.

5. The article of footwear of claim 1, wherein the plurality of multi-sided cell structures extend along the toe region of the article of footwear and along at least a portion of a lateral side of the article of footwear and along at least a portion of a medial side of the article of footwear.

6. The article of footwear of claim 1, wherein the upper further comprises a base layer with an exterior surface, and the exterior surface of the base layer is exposed within an area circumscribed by the first, second, third, and fourth sides of at least some of the plurality of multi-sided cell structures.

7. The article of footwear of claim 1, wherein the warp knit element defines a warp direction and a weft direction, the upper further comprises a base layer with an exterior surface, and the warp knit element is secured to the exterior surface of the base layer, wherein the warp knit element is expanded from a contracted position to an expanded position prior to being secured to the base layer.

8. The article of footwear of claim 1, wherein the warp knit element is substantially non-extensible along the warp direction to provide support to the article of footwear.

9. The article of footwear of claim 8, wherein the warp direction extends substantially in a vertical direction away from the sole structure.

10. The article of footwear of claim 1, wherein the warp knit element extends across a majority of a length of a medial side of the article of footwear and a majority of a length of a lateral side of the article of footwear.

11. The article of footwear of claim 1, wherein the warp knit element is substantially non-extensible along the warp direction to provide support to the article of footwear, and the warp direction extends substantially in a vertical direction away from the sole structure.

12. An article of footwear comprising:

a sole structure; and an upper that includes an integral expanded warp knit element that extends along at least a portion of a lateral side of the article of footwear and along at least a portion of a medial side of the article of footwear, and extends from the sole structure to a lacing region of the upper, the warp knit element comprising a plurality of cell structures, each cell structure having four sides and an opening in an area circumscribed by the four sides, wherein each cell structure comprises a bottom junction secured at the sole structure, a top junction secured at the lacing region, and opposing first and second side junctions located on the upper between the sole structure and the lacing region.

13. The article of footwear of claim 12, wherein adjacent cell structures of the plurality of multi-sided cell structures are connected at an intersection of the first side junction of one cell structure and a second side junction of another, adjacent cell structure.

14. The article of footwear of claim 12, wherein the plurality of multi-sided cell structures form diamond-like shapes.

15. The article of footwear of claim 12, wherein the plurality of multi-sided cell structures extend along the entirety of a toe region of the article of footwear.

16. The article of footwear of claim 12, wherein the upper further comprises a base layer with an exterior surface, and the exterior surface of the base layer is exposed by the openings of the expanded warp knit element.

17. The article of footwear of claim 12, wherein the warp knit element defines a warp direction and a weft direction, the upper further comprises a base layer with an exterior surface, and the warp knit element is secured to the exterior surface of the base layer, wherein the warp knit element is expanded from a contracted position to an expanded position prior to being secured to the base layer.

18. The article of footwear of claim 12, wherein the warp knit element extends across a majority of a length of the medial side of the article of footwear and a majority of a length of the lateral side of the article of footwear.

* * * * *